US006606230B2

(12) United States Patent
Sawada et al.

(10) Patent No.: US 6,606,230 B2
(45) Date of Patent: Aug. 12, 2003

(54) CHIP-TYPE SURGE ABSORBER AND METHOD FOR PRODUCING THE SAME

(75) Inventors: Yoshihisa Sawada, Tokyo (JP); Yoshiyuki Tanaka, Tokyo (JP); Kouichirou Harada, Tokyo (JP); Yasuhiro Shatou, Tokyo (JP); Naoto Kitahara, Tokyo (JP); Kazutaka Hujiwara, Tokyo (JP); Takahiro Nakamoto, Tokyo (JP); Heisen Ryu, Tokyo (JP); Hitoshi Inaba, Tokyo (JP); Nobuya Saruwatari, Tokyo (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/745,472

(22) Filed: Dec. 26, 2000

(65) Prior Publication Data

US 2002/0167773 A1 Nov. 14, 2002

(30) Foreign Application Priority Data

Jun. 30, 2000 (JP) ..... 2000-199651
Jul. 31, 2000 (JP) ..... 2000-232208

(51) Int. Cl.[7] ..... H01C 7/12; H01H 3/22

(52) U.S. Cl. ..... 361/118; 361/111; 361/112; 174/256

(58) Field of Search ..... 361/117, 118, 361/119, 120, 121, 122, 123, 124, 125, 126, 56, 111, 91.1–91.8, 127–130, 134, 135, 212, 220, 748; 313/635; 156/273.1; 174/256

(56) References Cited

U.S. PATENT DOCUMENTS 3,900,767 A * 8/1975 Person ..... 317/61.5
6,084,759 A * 7/2000 Hansson et al. ..... 361/111
6,316,734 B1 * 11/2001 Yang ..... 174/256

FOREIGN PATENT DOCUMENTS

JP 09-223564 * 8/1997 ..... H01T/4/10
JP 09-223566 * 8/1997 ..... H01T/4/10
JP 2000-133409 * 5/2000 ..... H01T/4/12

OTHER PUBLICATIONS

"Corona Resistant Kapton CR Takes Electrical Insulation Design and Reliability to New Levels", Dupont Films, Document number H–54506–1, Jun. 1996.*

* cited by examiner

*Primary Examiner*—Kim Huynh
(74) *Attorney, Agent, or Firm*—Oblon, Spivak, McClelland, Maier & Neustadt, P.C.

(57) ABSTRACT

A chip-type surge absorber and method for producing same, wherein the chip-type surge absorber includes an insulating substrate in the shape of a rectangular parallelepiped; an insulating hermetic cap open at a bottom side thereof, for forming, together with the insulating substrate, a box-shaped hermetically sealed cavity filled with a discharge gas; terminal electrodes disposed at both ends in the hermetically sealed cavity; a pair of discharge electrodes which are formed in the hermetically sealed cavity such that a discharge gap is formed between the discharge electrodes and such that the discharge electrodes are electrically connected to corresponding terminal electrodes; and connection surfaces for increasing the connection area for the connection between the discharge electrodes and the terminal electrodes.

12 Claims, 13 Drawing Sheets

| NUMBER OF SURGE APPLICATIONS | 500 TIMES | 1000 TIMES | 1500 TIME |
|---|---|---|---|
| EXAMPLE 4A | 300 V | 300 V | 310 V |
| EXAMPLE 4B | 300 V | 300 V | 300 V |
| COMPARATIVE EXAMPLE 5 | 320 V | 340 V | 450 V |

*FIG. 7*

CHIP-TYPE SURGE ABSORBER AND METHOD FOR PRODUCING THE SAME

CROSS-REFERENCE TO RELATED APPLICATIONS

The present invention is related to Japanese Patent Applications Nos. 11-155464, 11-210499, 11-210500, 11-341476, 2000-199651, and 2000-232208, and claims priority under 35 USC §119 to Japanese Patent Application No. 2000-199651, filed on Jun. 30, 2000, and Japanese Patent Application No. 2000-232208, filed on Jul. 31, 2000, the entire contents of all of which is incorporated by reference herein.

BACKGROUND OF THE INVENTION

1. Field of the Invention

The present invention relates to a chip-type surge absorber for protecting an electronic circuit, a communication device, and the like from a surge such as a lightning surge or noise, and also to a method of producing such a chip-type surge absorber.

2. Discussion of the Background

In order to protect electronic circuits and communication devices from internal or external surges or noise, various types of surge absorbers have been developed and are used effectively. In general, a surge absorber is disposed at a connection point at which an electronic device such as a telephone or a modem is connected to a communication line or is disposed in parallel to a circuit such as a CRT driver circuit or a device which is subject to an electrical impulse such as a lightning surge or electrostatic discharge so as to protect the circuit or the device from the surge by shunting the surge current. In some cases, a surge absorber is disposed in a ground circuit so that a surge current is shunted to ground thereby protecting circuits.

Among various types of surge absorbers, the surge absorber 140 of the type shown in FIG. 13 is widely used because of its good surge response and long life.

The surge absorber of this type is made up of an absorber element enclosed together with a discharge gas within a glass tube 146 sealed at both ends with cap electrodes 143 each having a slag lead 145 wherein the absorber element is made up of a cylindrical-shaped insulator 141 covered with a conductive film 142 having a discharge gap 142A formed at the center thereof.

The principle of operation of the surge absorber 140 is as follows. When a circuit is in a normal operating state, no current flows through the surge absorber 104 because of the existence of the discharge gap 142A formed at the center of the conductive film 142. However, if a surge such as an indirect lightning stroke is input to the circuit, a voltage depending upon the surge is applied across the discharge gap 142A. If this surge voltage is equal to or greater than the discharge start voltage of the surge absorber 140, the discharge gap 142A has an electrical breakdown, and a glow discharge occurs in the discharge gap 142A. If the surge continues further, the temperature of the discharge gas becomes high, and the discharge gas is ionized. Thus, the glow discharge grows into an arc discharge which occurs between the cap electrodes 143. As a result, the surge absorber becomes possible to shunt a greater surge current.

As a result, no surge is applied to the circuit or device which should be protected, and thus the circuit or device is prevented from being damaged. The surge absorber is not damaged fatally only by one discharge, but, in many cases, the surge absorber can withstand a large number of impacts of surges such as about 1000 impacts. In this respect, surge absorbers are very different from fuses which are broken by a single impact of a surge and which must be replaced whenever being broken.

However, the structure of the surge absorber 140 does not allow it to be surface-mounted on a circuit board, because lead wires are necessary for connection with an external circuit. Another problem of the surge absorber 140 is that it is difficult to reduce the size because it is necessary to enclose the cylindrical-shaped insulator 141 within the glass tube 146.

Therefore, the conventional surge absorber 140 does not meet the requirements for electronic circuits with small sizes and high densities.

One technique to overcome the above problems while maintaining the performance of the surge absorber has been proposed in Japanese Unexamined Patent Application Publication No. 8-64336. FIG. 14 illustrates a chip-type surge absorber 150 according to the technique disclosed in Japanese Unexamined Patent Application Publication No. 8-64336 cited above. The chip-type surge absorber 150 includes an insulating substrate 151 in the shape of a rectangular parallelepiped, discharge electrodes 152 formed on the surface of the insulating substrate 151, a discharge gap 153 formed between the discharge electrodes 152, and a pair of terminal electrodes 154 which are electrically connected to the respective discharge electrodes 152 and which are disposed on respective ends of the insulating substrate 151. Furthermore, a hermetic cap 156 is adhesively bonded to the insulating substrate 151 so as to form a hermetically sealed cavity 155 filled with a discharge gas in which the discharge gap 153 and a part of each discharge electrode 152 are enclosed.

The chip-type surge absorber 150 can be surface-mounted on a circuit board by electrically connecting the terminal electrodes to an external circuit via solder. In this chip-type surge absorber 150, the glass tube and the cap electrodes for the purpose of encapsulation are not required, and thus it is possible to reduce the size. The principle of operation is basically the same as that of the surge absorber 140, and thus the surge absorber 150 has similar performance to that of the surge absorber 140.

Although the chip-type surge absorber 150 has the advantage that it can be surface-mounted on a circuit board, the small volume of the hermetically sealed cavity 155 in which a discharge occurs results in small surge resistance.

In the chip-type surge absorber 150, the electrical connection between the discharge electrodes 152 and the corresponding terminal electrodes 154 is realized by forming the discharge electrodes 152 so as to extend to both ends of the insulating substrate 151 and disposing the terminal electrodes 154 directly upon the discharge electrodes 152. To this end, it is necessary that the end faces of the hermetic cap 156 should be at locations shifted inwardly from the ends of the insulating substrate 151 so as to create areas on the insulating substrate 151 where the discharge electrodes 152 are exposed to the outside. However, this results in a reduction in the volume of the hermetically sealed cavity 155. In the chip-type surge absorber 150 shown in FIG. 14, because the surge resistance is proportional to the volume of the hermetically sealed cavity 155, the structure of the chip-type surge absorber 150 results in a reduction in the surge resistance. The above problem may be solved by increasing the surface area of the insulating substrate 151. However, in this case, the resultant penalty is an increase in the mounting area.

The reason why the chip-type surge absorber 150 has the above-described structure is that if the terminal electrodes 154 are formed on the end faces of the insulating substrate 151, it is not assured that the terminal electrodes 154 are electrically connected to the discharge electrodes 154 which are formed, to achieve a long life, so as to have a thickness as small as 1 $\mu$m. In particular, in the case where there area plural pairs of discharge electrodes 152, it is very difficult to achieve electrically connection for all pairs of discharge electrodes 152.

In order to trigger the discharge, it is required that electrons which start the discharge be emitted by a high voltage which is induced across the discharge gap by an surge applied to the surge absorber. However, in the chip-type surge absorber 150 shown in FIG. 14 in which there is only one pair of discharge electrodes 152 and there is only one discharge gap 153, there is no particular point where an electric field is concentrated, and thus a delay occurs in starting of the discharge.

Another problem is that the structure of the chip-type surge absorber 150 shown in FIG. 14 is not symmetrical in a vertical direction. Therefore, when the chip-type surge absorber 150 is mounted, it is necessary to correctly place the chip-type surge absorber 150 in the vertical direction. This results in an increase in complexity in the process of automatically mounting chip-type surge absorbers on circuit boards.

Other examples of conventional chip-type surge absorbers are shown in FIGS. 15 and 16.

In the example shown in FIG. 15, the chip-type surge absorber 160 is made up of an insulating substrate 161 having a cavity extending through the insulating substrate 161, a pair of terminal electrodes 162 which are disposed on the respective ends of the insulating substrate 161 such that the above-described cavity is closed by the terminal electrodes 162, a hermetically sealed cavity 163 which is enclosed by the insulating substrate 161 and the terminal electrodes 162 and which is filled with a discharge gas, and a pair of discharge electrodes 165 which are formed within the hermetically sealed cavity 163 and on the insulating substrate 161 such that a discharge gap 164 is formed between the discharge electrodes 165, wherein the terminal electrodes 162 are electrically connected to the corresponding discharge electrodes 165.

On the other hand, in the example shown in FIG. 16, the chip-type surge absorber 170 is made up of an insulating substrate 171 made of alumina or a similar material, discharge electrodes 172 and 173 which are formed at opposing positions on the surface of the insulating substrate 171, a discharge gap 174 formed between the discharge electrodes 172 and 173, a box-shaped hermetic cap 176 made of glass (insulating material) whose peripheral part is adhesively bonded to the insulating substrate 171 such that a hermetically sealed cavity 175 is formed above the discharge electrodes 172 and 173 and such that the hermetically sealed cavity 175 is filled with a discharge gas, and terminal electrodes 177 and 178 which are formed such that both ends of the hermetic cap 176 and both ends of the insulating substrate 171 are covered with the respective terminal electrodes 177 and 178 and such that the discharge electrodes 172 and 173 are electrically connected to the respective terminal electrodes 177 and 178.

If a surge voltage is applied between the discharge electrodes 172 and 173 via the discharge gap 174, a glow discharge is triggered between the discharge electrodes 172 and 173 via the discharge gap 174 as represented by a symbol B in FIG. 16. The discharge grows into a creeping discharge within the hermetically sealed cavity 174 toward the outer-side ends of the discharge electrodes 172 and 173 as represented by arrows C. Finally, the discharge grows into an arc discharge between the discharge electrodes 172 and 173 as represented by an arrow D, which results in absorption of the surge voltage.

There is a need for chip-type surge absorbers which can withstand high surge voltages and thus has high reliability and long life.

In the chip-type surge absorbers 150, 160, and 170 described above, when a surge is applied over a long period of time, a glow discharge grows into an arc discharge between the terminal electrodes. However, because the structure of the chip-type surge absorbers allows low heat dissipation, the arc discharge results in an increase in internal temperature to a few thousands of degrees (centigrade). Because the discharge electrodes are made of ceramic or metal having a high melting point, only one or two discharges do not result in damage. However, when the chip-type surge absorbers are used in circuits which are subject to frequent long-period surges, the electrically conductive film forming the discharge electrodes are damaged by heat generated by the repetition of discharges, and the gap distance of the discharge gap becomes greater. Because the discharge start voltage depends upon the gap distance of the discharge gap, the expansion of the discharge gap results in an increase in the discharge start voltage, which causes an unexpected large voltage to be applied to an electronic circuit or a communication device. Such a high voltage can cause the electric circuit or the communication device to be broken.

When an arc discharge occurs in the chip-type surge absorber, the arc current flows via small points into the outer-side end parts of the discharge electrodes. As a result, local areas near the small points have a very high current density and a high temperature. In the case of the structure shown in FIG. 16 in which the insulating substrate 171 and the hermetic cap 176 are adhesively bonded to each other, the adhesive by which the hermetic cap 176 are connected to each other is melted by the heat, the hermetic cap 176 can be opened. This causes the chip-type surge absorber to be broken by a surge current as small as about 30 A.

Japanese Unexamined Patent Application No. 2000-12186 discloses another chip-type surge absorber.

In this chip-type surge absorber disclosed in Japanese Unexamined Patent Application No. 2000-12186, discharge starting electrodes are formed of diamond under discharge electrodes. One of the inherent properties of diamond is that it has a small work function which allows diamond to easily emit electrons. Therefore, in response to a surge voltage, electrons are emitted by field emission from the discharge starting electrode made of diamond even when the surge voltage is low. Thus, this type of surge absorber can operate at low voltages.

There is also a need for a chip-type surge absorber which operates at a low surge voltage and which can be used in high-frequency circuits.

In the chip-type surge absorbers, because an insulating substrate having a uniform relative dielectric constant is used, the insulating substrate has no particular point where an electric field is concentrated, and the discharge start voltage is determined by the work function of the discharge electrodes employed and by the discharge gas in the hermetically sealed cavity. Therefore, the only way to reduce the discharge start voltage is to properly select the material of the discharge electrodes or the discharge gas.

In the chip-type surge absorber disclosed in Japanese Unexamined Patent Application No. 2000-12186 in which the discharge starting electrodes are formed using diamond, it is necessary to form a thin diamond film using a complicated large-scale apparatus by means of a CVD process or slurry method under precisely controlled process conditions. This makes it difficult to produce this type of surge absorber.

Although not shown, one possible technique to reduce the operating voltage is to form the insulating substrate using a dielectric material having a large relative dielectric constant thereby allowing an electric field to be concentrated. However, this technique results in an increase in the total capacitance, and the insulating substrate acts as a low-pass filter. Therefore, although this type of surge absorber can operate at low voltages, it cannot be used in high-frequency circuits. In other words, it is difficult to realize a chip-type surge absorber which can operate at low voltages and which can be used in high-frequency circuits.

One conventional technique of producing a chip-type surge absorber is described below with reference to FIGS. 17 to 19. First, as shown in FIGS. 17 and 18, discharge electrodes 183 are formed on a heat-resistant electrically-insulating substrate 181 which can provide hermeticity, and a discharge gap 185 with a gap distance of 0.1 to 500 $\mu$m is formed between the discharge electrodes 183 by means of laser cutting. A peripheral part of the substrate 181 is then coated with an adhesive 187. A hermetic cap 191 is then placed on the substrate 181 such that an enclosed space 189 serving as a hermetically sealed cavity is formed as shown in FIG. 19. The hermetic cap 191 is adhesively bonded to the substrate 181 such that the discharge gap 185 is located at the center of the enclosed space 189 and such that the far ends of the respective discharge electrodes 183 are exposed to the outside of the hermetic cap 191. The adhesively bonding of the hermetic cap 191 is performed in atmospheric air or in an ambient of an inert gas so that the enclosed space 189 is filled with a desired gas. Finally, terminal electrodes 193 are connected to the externally exposed parts of the respective discharge electrodes 183 as shown in FIG. 20 by means of baking or plating. Thus, the production of the chip-type surge absorber 195 is completed.

In the step of forming the discharge gap 185 according to the above-described conventional production method of the chip-type surge absorber, the gap distance of the discharge gap 185 is adjusted by means of laser cutting such that the discharge start voltage is correctly determined by the gap distance of the discharge gap 185. In the chip-type surge absorber, if the discharge gap 185 is formed so as to have a deep undercut, it becomes possible to prevent the discharge gap 185 from being bridged by conductive dust generated from the discharge electrodes 183, thereby allowing the surge absorber to have a longer absorbing life during which the surge absorber has the surge absorption function.

However, it is difficult to achieve both the reduction in the discharge start voltage and the increase in the life, as described below.

In order to reduce the discharge start voltage, it is necessary to form the discharge gap 185 to have a small gap distance, and thus it is necessary to reduce the laser output power. However, the reduction in the laser output power makes it difficult to form a deep undercut into the substrate 181 made of a refractory material. Thus, the reduction in the discharge start voltage causes a reduction in the life.

Conversely, if the laser cutting is performed with high optical power so as to form a deep undercut into the substrate 181, the life can be increased. However, as the depth of the discharge gap 185 increases, the gap distance of the discharge gap increases. Therefore, in this case, a low discharge start voltage cannot be obtained.

The formation of the deep undercut which is necessary for the increase in life is also difficult for the following reason.

That is, because the substrate 181 made of a refractory material is poor in heat dissipation, heat generated during a discharge can be transferred only through a path formed by the discharge electrodes 183 and the terminal electrodes 193. If the thickness of the discharge electrodes 183 forming the heat transfer path is not sufficiently large, heat is not transferred sufficiently. Therefore, when the chip-type surge absorber is continuously subjected to a plurality of surges, the heat generated cannot be removed sufficiently, and the discharge electrodes 183 are degraded. As a result, a change occurs in the electrical characteristic of the chip-type surge absorber. The above problem can be solved, if the discharge electrodes 183 are formed to have a sufficiently large thickness to obtain good heat dissipation. However, the increase in the thickness of the discharge electrodes 183 makes it difficult to form a deep undercut into the substrate 181.

SUMMARY OF THE INVENTION

An object of the present invention is to provide a chip-type surge absorber whose surge resistance is increased without causing an increase in the mounting area.

According to an aspect of the present invention, to achieve the above object, there is provided a chip-type surge absorber including: an insulating substrate in the shape of a rectangular parallelepiped; an insulating hermetic cap open at a bottom side thereof, for forming, together with the insulating substrate, a box-shaped hermetically sealed cavity filled with a discharge gas; terminal electrodes disposed at both ends in the hermetically sealed cavity; a pair of discharge electrodes which are formed in the hermetically sealed cavity such that a discharge gap is formed between the discharge electrodes and such that the discharge electrodes are electrically connected to corresponding terminal electrodes; and connection surfaces for increasing the connection area for the connection between the discharge electrodes and the terminal electrodes.

In this chip-type surge absorber, the discharge electrodes are overlapped with the corresponding terminal electrodes over wide areas thereby assuring good electrical connection between the discharge electrodes and the terminal electrodes even when the discharge electrodes have a small thickness such as 1 $\mu$m. This structure allows the hermetic cap to be connected to the insulating substrate such that the ends of the hermetic cap become flush with the corresponding ends of the insulating substrate. As a result, the volume of the hermetically sealed cavity is increased to a maximum possible value, which results in an increase in surge resistance. More specifically, the discharge electrodes extend over the connection surfaces such that the discharge electrodes are overlapped with the corresponding terminal electrodes on the connection surfaces, thereby assuring good electrical connection. Thus, it becomes possible to dispose the hermetic cap such that the ends of the hermetic cap become flush with the corresponding ends of the insulating substrate, thereby increasing the volume of the hermetically sealed cavity, which results in an increase in surge resistance. Another advantage of this chip-type surge absorber is that it has a symmetrical external shape in a vertical direction, and thus it is not necessary, in a mounting process, to distinguish which is an upper side or which is a lower side.

Another object of the present invention is to provide a chip-type surge absorber having large surge resistance and having a small discharge start delay.

According to another aspect of the present invention, to achieve the above object, there is provided a chip-type surge absorber including: an insulating substrate in the shape of a rectangular parallelepiped; an insulating hermetic cap open at a bottom side thereof, for forming, together with the insulating substrate, a box-shaped hermetically sealed cavity filled with a discharge gas; terminal electrodes disposed at both ends in the hermetically sealed cavity; two to five pairs of discharge electrodes which are formed in the hermetically sealed cavity such that a discharge gap is formed between each pair of discharge electrodes and such that the discharge electrodes are electrically connected to the corresponding terminal electrodes; and connection surfaces for increasing the connection area for the connection between the discharge electrodes and the terminal electrodes.

In this chip-type surge absorber, the discharge electrodes are overlapped with the corresponding terminal electrodes over wide areas thereby assuring good electrical connection between the discharge electrodes and the terminal electrodes even when the discharge electrodes have a small thickness such as 1 $\mu$m. This structure allows the hermetic cap to be connected to the insulating substrate such that the ends of the hermetic cap become flush with the corresponding ends of the insulating substrate. As a result, the volume of the hermetically sealed cavity is increased to a maximum possible value, which results in an increase in surge resistance. More specifically, the discharge electrodes extend over the connection surfaces such that the discharge electrodes are overlapped with the corresponding terminal electrodes on the connection surfaces, thereby assuring good electrical connection. Thus, it becomes possible to dispose the hermetic cap such that the ends of the hermetic cap become flush with the corresponding ends of the insulating substrate, thereby increasing the volume of the hermetically sealed cavity, which results in an increase in surge resistance. Good electrical connection between the discharge electrodes and the terminal electrodes can be obtained even when there are a large number of pairs of discharge electrodes.

The existence of two to five pairs of the discharge electrodes results in creation of points where an electric field is concentrated when a surge is applied. This allows a discharge to quickly start in response to a surge without having a significant delay. This chip-type surge absorber also has the advantage that it has a symmetrical external shape in a vertical direction, and thus it is not necessary, in a mounting process, to distinguish which is an upper side or which is a lower side.

A still another object of the present invention is to provide a chip-type surge absorber which is not broken by a surge voltage.

According to still another aspect of the present invention, to achieve the above object, there is provided a chip-type surge absorber including an insulating substrate, discharge electrodes which are formed at opposing positions on the insulating substrate such that a discharge gap is formed between the discharge electrodes, a hermetic cap having a peripheral part thereof adhesively bonded to the insulating substrate such that a space above the discharge electrodes is enclosed by the hermetic cap, wherein each of the discharge electrodes has an outer-side end part at a location where the hermetic cap and the insulating substrate are adhesively bonded to each other, and the outer-side end part has a lower electrical resistance than the electrical resistance of the inner-side part of a discharge electrode directly adjacent to the discharge gap.

In this chip-type surge absorber, when a discharge occurs in response to an applied surge voltage, an arc discharge current flows via a particular point of each outer-side end part into the outer-side end parts of the discharge electrodes. However, because the outer-side end parts of the discharge electrodes have a low electrical resistance, the arc current is spread out, and thus the current density of the arc current flowing through the connection part between the hermetical cap and the insulating substrate is reduced, and the increase in temperature is suppressed.

As a result, it becomes possible to prevent the hermetic cap from becoming open by a surge voltage. Thus, the resistance to the surge voltage is improved, and the surge withstanding voltage is increased.

It is still another object of the present invention to provide a chip-type surge absorber having high reliability and a long life.

According to still another aspect of the present invention, to achieve the above object, there is provided a chip-type surge absorber including: an insulating substrate in the shape of a rectangular parallelepiped having a cavity extending through the insulating substrate; a pair of terminal electrodes which are disposed on the respective ends of the insulating substrate such that the cavity is closed by the terminal electrodes; a hermetically sealed cavity which is enclosed by the insulating substrate and the terminal electrodes and which is filled with a discharge gas; and a pair of discharge electrodes which are formed within the hermetically sealed cavity and on one inner surface of the insulating substrate such that a discharge gap is formed between the discharge electrodes, the discharge electrodes being electrically connected with the corresponding terminal electrodes, wherein a relay electrode for relaying an arc discharge is formed within the hermetically sealed cavity and on the other inner surface of the insulating substrate such that the relay electrode is isolated from the discharge electrodes and the terminal electrodes.

In this chip-type surge absorber, if an arc discharge occurs between the terminal electrodes due to a long-period surge, the inside of the hermetically sealed cavity is raised to a high temperature. However, the relay electrode disposed at a location isolated from the discharge electrodes and the terminal electrodes allows the arc discharge to partially occur via the relay electrode. As a result, the arc discharge partially occurs between the relay electrode and the terminal electrodes, and thus the amount of discharge between the discharge electrodes is reduced. This results in a reduction in the amount of discharge between the discharge electrodes. Therefore, a great reduction in the heat load upon the discharge electrodes is achieved. As a result, the discharge gap has high resistance against a large number of surges applied to the discharge gap, and thus the chip-type surge absorber has a long life.

It is still another object of the present invention to provide a chip-type surge absorber having a low discharge start voltage and also having a long life.

According to still another aspect of the present invention, to achieve the above object, there is provided a chip-type surge absorber including: a heat-resistant insulating substrate; a pair of discharge electrodes which are formed on the heat-resistant insulating substrate such that a small gap is formed between the discharge electrodes; and a hermetic cap which is adhesively connected to the insulating substrate such that the small gap is enclosed in a hermetically sealed space formed by the hermetic cap, wherein a stripe-shaped insulating layer having heat resistance lower at least than the heat resistance of the insulating substrate is formed between the insulating substrate and the discharge electrodes.

In this chip-type surge absorber, because the stripe-shaped insulating layer having heat resistance lower at least than the heat resistance of the insulating substrate is formed between the insulating substrate and the discharge electrodes, the insulating layer having low heat resistance is easily cut deeply when the small gap serving as the discharge gap is formed by means of laser cutting. This makes it possible to form the discharge gap so as to have a small gap distance and a large depth. As a result, it becomes possible to obtain a low discharge start voltage, and it also becomes possible to prevent the discharge gap from being filled with electrically conductive dust. Thus, it is possible to achieve both low discharge start voltage and long life at the same time.

It is still another object of the present invention to provide a method of producing a chip-type surge absorber having a low discharge start voltage and also having a long life.

According to still another aspect of the present invention, to achieve the above object, there is provided a method of producing a chip-type surge absorber, including the step of: forming a stripe-shaped insulating layer on a flat substrate surface of a heat-resistant insulating substrate, the insulating layer having lower heat resistance than the heat resistance of the insulating substrate; forming an electrically conductive film having the same stripe shape as the stripe-shaped insulating layer on the stripe-shaped insulating layer having low heat resistance into a multilayer structure; and cutting the electrically conductive film together with the insulating layer having low heat resistance in a direction perpendicular to the longitudinal direction by means of laser cutting, into two portions which serve as a pair of discharge electrodes spaced from each other by a small gap;

In this method of producing the chip-type surge absorber, the insulating layer having low heat resistance is formed on the insulating substrate, and the electrically conductive film formed on the insulating layer having low heat resistance is cut together with the insulating layer into two portions by means of laser cutting. Therefore, the insulating layer having low heat resistance is cut deeply together with the electrically conductive film using a laser with low optical output power. Thus, it is possible to easily obtain a chip-type surge absorber having a discharge gap with a small gap distance and a large depth.

It is still another object of the present invention to provide a chip-type surge absorber which can operate at low voltages and which can be used in high-frequency circuits.

According to still another aspect of the present invention, to achieve the above object, there is provided a chip-type surge absorber including an insulating substrate; discharge electrodes which are formed at opposing positions on the insulating substrate such that a discharge gap is formed between the discharge electrodes; and dielectric layers disposed between the insulating substrate and the respective discharge electrodes, wherein the dielectric layers have a relative dielectric constant greater than that of the relative dielectric constant of the insulating substrate, and at least a part of each of the dielectric layers is exposed in the discharge gap.

In this chip-type surge absorber, because the dielectric layers having a relative dielectric constant greater than the relative dielectric constant of the insulating substrate are formed between the insulating substrate and the respective discharge electrodes such that the dielectric layers are partially exposed in the discharge gap, when a surge voltage is applied, an electric field is concentrated in the dielectric layers via the discharge electrodes, and electrons are emitted from the parts of the electrode in direct connection with the dielectric layers. This allows initial electron emission to start between the discharge electrodes at a low voltage. Therefore, it is possible to achieve a chip-type surge absorber which can operate at a low voltage without having limitations in terms of the work function of the discharge electrodes and in terms of the characteristic of the discharge gas. Furthermore, because the dielectric layers are formed only in limited areas between the insulating substrate and the discharge electrodes such that the dielectric layers are partially exposed in the discharge gap, no increase in capacitance occurs, and therefore this chip-type surge absorber can be employed also in high-frequency circuits.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 7 is a table illustrating the result of the life test for the chip-type surge absorbers according to the fourth embodiment and conventional chip-type surge absorbers;

DETAILED DESCRIPTION OF THE PREFERRED EMBODIMENTS

Figure 1A:
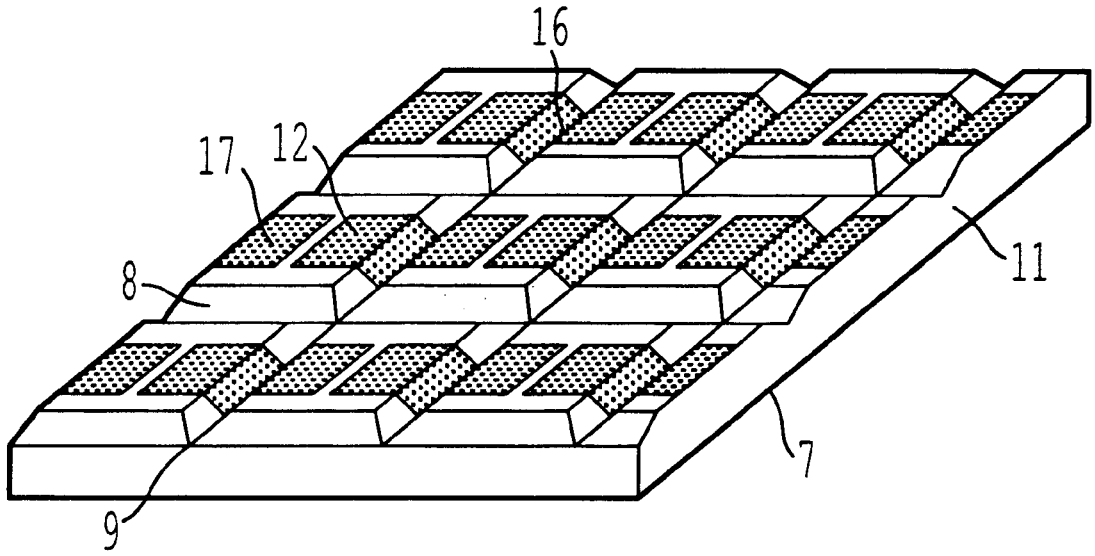
FIG. 1A is a perspective view illustrating a first embodiment of a chip-type surge absorber and a production method thereof, according to the present invention, wherein an insulating sheet, separation grooves, discharge electrodes, and discharge gaps are shown.

Referring now to the accompanying drawings, wherein like reference numerals designate identical or corresponding parts throughout the several views or diagrams, and more particularly to FIGS. 1 through 12, wherein there are illustrated various embodiments of the present invention as will now be described.

First Embodiment

Referring to FIG. 1, a first embodiment of a chip-type surge absorber according to the present invention and a production method thereof are described below.

Figure 1B:
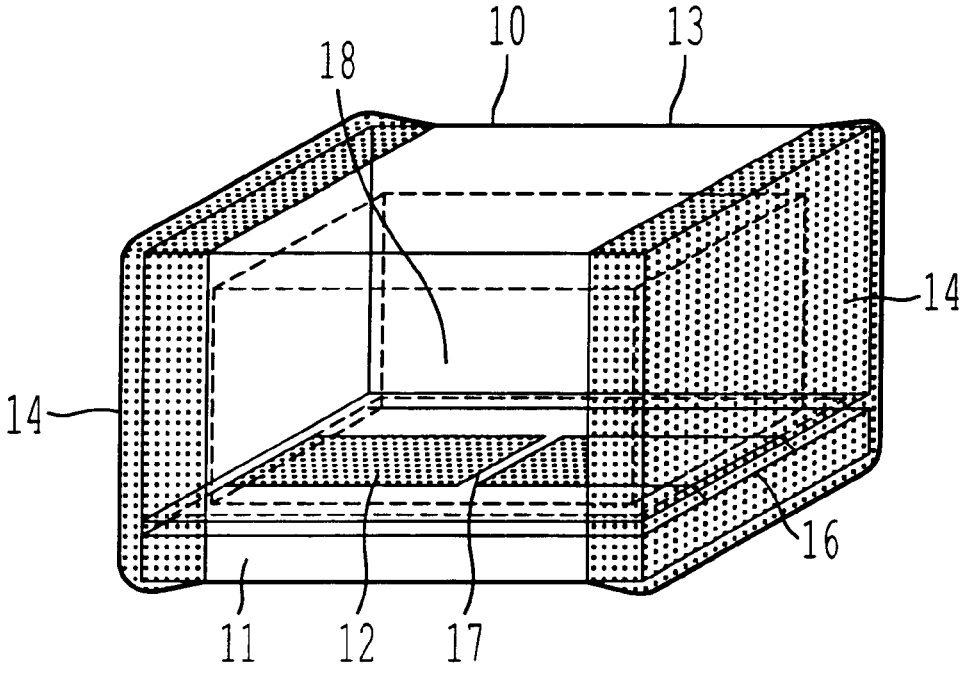
FIG. 1B is a perspective view illustrating the chip-type surge absorber in the complete form according to the first embodiment of the present invention.

As shown in FIG. 1B, the chip-type surge absorber 10 according to the first embodiment includes an insulating substrate 11 in the shape of a rectangular parallelepiped; an insulating hermetic cap 13 open at a bottom side thereof, for forming, together with the insulating substrate, 11 a box-shaped hermetically sealed cavity 18 filled with a discharge gas; terminal electrodes 14 disposed at both ends of the hermetical cavity 18; and a pair of discharge electrodes 12 which are formed in the hermetically sealed cavity 18 such that a discharge gap 17 is formed between the discharge electrodes 12 and such that the discharge electrodes are electrically connected to corresponding terminal electrodes 14. The discharge electrodes 12 each have a connection surface 16 for increasing the connection area for the connection between the discharge electrodes 12 and the terminal electrodes 14.

The chip-type surge absorber 10 having the above-described structure is produced as follows. First, as shown in FIG. 1A, an insulating sheet 7 is divided into a plurality of pieces each of which serves as the insulating substrate 11. A commercially-available insulating sheet may be employed as the insulating sheet 7. Alternatively, the insulating sheet 7 may be obtained by firing a green sheet having a desirable composition.

In the present embodiment, the insulating substrate 11 is preferably formed of a material such as ceramic or glass having a high heat resistance and a high mechanical strength. In particular, mullite and aluminum are excellent as the material for the substrate in terms of the melting point, the mechanical strength, and the cost.

In order to facilitate the separation of the insulating sheet 7 into a plurality pieces, separation grooves 8 and 9 are formed on a surface of the insulating sheet 7 on which the discharge electrodes 12 are to be formed. The separation grooves 8 extending in one direction may be formed into an arbitrary shape as long as the grooves facilitate the separation. The separation grooves 9 extending in the other direction also serve as connection surfaces 16 on the insulating substrate 11. Therefore, the separation grooves 9 are preferably formed in a V-shape or a similar shape so that the discharge electrodes 12 can be easily formed. The separation grooves 8 and 9 may be formed by pressing an embossing die against a green sheet.

Preferably, the depth of the separation grooves 8 and 9 is equal to or less than 0.6 mm and the width is equal to or less than 1.2 mm, although the optimum values thereof depend upon the size of the chip-type surge absorber 10. If the width of the separation grooves 8 and 9 is too great, the volume of the hermetically sealed cavity 18 becomes small. In this specific embodiment, the V-shaped separation groove 9 is formed so as to have a depth of 0.2 mm and a width of 0.4 mm. Thus, the length of the discharge electrode 12 formed on the connection surface 16 becomes slightly less than 0.3 mm, which allows the discharge electrode 12 to overlap with the terminal electrode 14 over a wide area and thus assures good electrical connection between the discharge electrode 12 and the terminal electrode 14.

The connection surfaces 16 may also be formed on the hermetic cap 13, in addition to those formed on the insulating substrate 11.

A conductive film with a thickness of 1 $\mu$m for the discharge electrodes 12 is then formed. The discharge electrodes 12 are formed into the shape of a pair of stripes such that they extend also over the connection surfaces 16. The discharge electrodes 12 are preferably formed using one material selected from the group consisting of $RuO_2$, Ti, TiO, TiN, Ta, W, SiC, $SnO_2$, BaAl, Si, C, Pd, Pt, Au, Ag, V, Al, La, and Nb or a combination of two or more materials selected of the group, by means of printing, evaporation, or sputtering. The conductive film is the cut at the center thereof so as to form the discharge gap 17 having a width within the range of 1 $\mu$m to 500 $\mu$m.

Subsequently, the insulating substrate 11 is covered with the hermetic cap 13 such that the hermetically sealed cavity 18 with the box shape is formed, wherein the hermetic cap 13 and the insulating substrate 11 is adhesively bonded to each other using a glass paste. The hermetic cap 13 may be made of a material similar to that of the insulating substrate 11. The bonding between the hermetic cap 13 and the insulating substrate 11 is performed in an ambient of a discharge gas so that the hermetically sealed cavity 18 is filled with a discharge gas.

Various kinds of gases which can be ionized at high temperatures may be employed as the discharge gas. For example air may be employed as the discharge gas. However, in order to achieve high stability at high temperatures, it is preferable to employ a gas or a mixture of gasses selected from the group consisting of He, $N_2$, Ar, Xe, Ne, $SF_6$, $CO_2$, $H_2$, and $C_2F_6$.

After bonding the hermetic cap 13 and the insulating substrate 11 to each other, the insulating sheet 7 is divided along the separation grooves 8 and 9.

After dividing the insulating sheet 7, the terminal electrodes 14 are formed. The terminal electrodes 14 may be formed by coating a metal paste at least on the end faces of the insulating substrate 11 and the end faces of the hermetic cap 13 by means of dipping. In this process, the spaces above the connection surfaces 16 are also filled with the metal paste. The above-described manner of forming the terminal electrodes 14 assures electric connection of the terminal electrodes 14 to the respective discharge electrodes 12 and also to an external circuit. It is desirable that the terminal electrodes 14 be formed not such that they are formed only on the end faces but such that they extend slightly to side faces from the end faces as shown in FIG. 1B.

The terminal electrodes 14 are preferably formed of metal such as Ag, Pt, Au, Pd, Sn, and Ni or an alloy of two or more such metals.

The terminal electrodes 14 are baked into a firmly adhered form, and thus the production of the chip-type surge absorber 10 is completed.

In the chip-type surge absorber 10 produced in the above-described manner, the discharge electrodes 12 extend over the connection surfaces 16 such that the discharge electrodes 12 are overlapped, in the areas of the connection surfaces 16, with the terminal electrodes 14 thereby achieving good electrical connections between them. This allows the hermetic cap 13 to be disposed such that the ends of the hermetic cap 13 become flush with the corresponding ends of the insulating substrate 11. This allows an increase in the volume of the hermetically sealed cavity 18, and thus the surge resistance is enhanced. Because the chip-type surge absorber 10 is symmetrical in shape in a vertical direction, it is not necessary to distinguish which is an upper side or which is a lower side when the chip-type surge absorber 10 is mounted on a circuit board or the like.

The performance of the chip-type surge absorber 10 according to the present embodiment has been compared with that of a conventional chip-type surge absorber. The result is described below.

Chip-type surge absorbers according to the present invention were produced using an insulating sheet of mullite with a size of 128 mm×64 mm×0.5 mm in accordance with the production method described above, thereby obtaining samples of Example 1.

In Example 1, the chip-type absorbers formed on the insulating sheet were separated into individual pieces each having a size of 3.2 mm×1.6 mm×0.5 mm.

The discharge electrodes were formed of a TiN film with a thickness of 1 $\mu$m and a width of 300 $\mu$m, and the discharge gap was formed so as to have a gap distance of 30 $\mu$m.

The hermetic cap was formed of mullite so as to have an external size of 3.2 mm×1.6 mm×1.1 mm and an internal size of 2.4 mm×0.8 mm×0.8 mm. The terminal electrodes were formed of an Ag/Pd alloy, and Ar was employed as the discharge gas.

Figure 14:
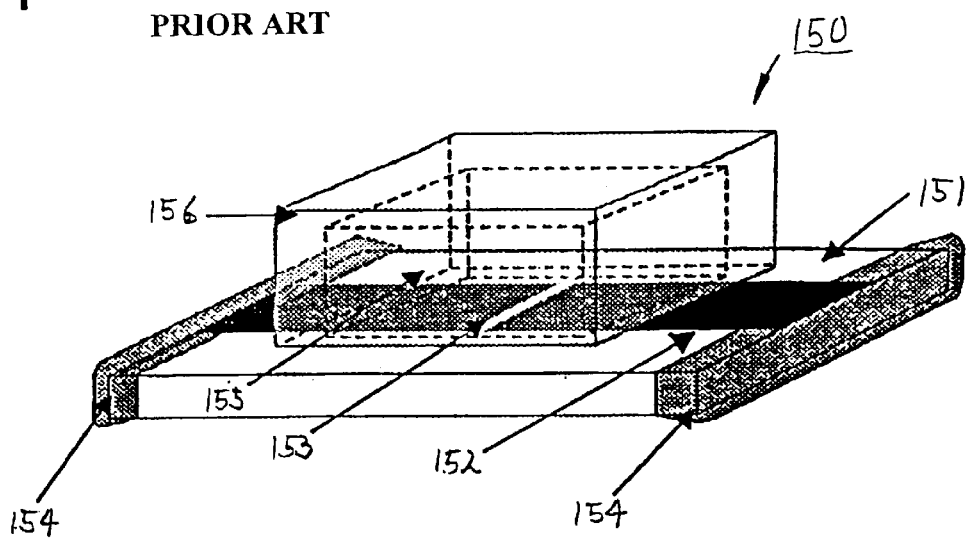
FIG.14 PRIOR ART
FIG. 14 is a schematic diagram illustrating another example of a conventional chip-type surge absorber.
Figure 13:
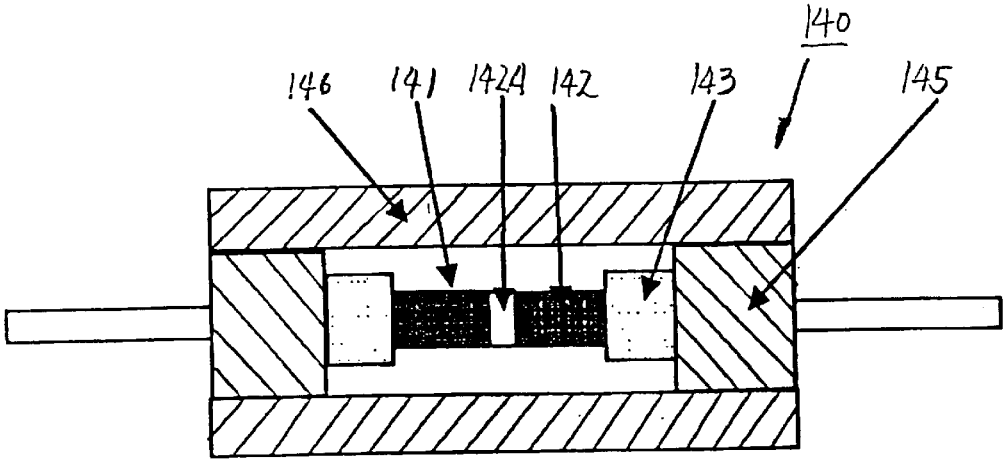
FIG.13 PRIOR ART
FIG. 13 is a schematic diagram illustrating an example of a conventional surge absorber.

Chip-type surge absorbers 150 having the structure shown in FIG. 14 were also produced thereby obtaining samples denoted herein as Comparative Example 1.

In the samples of the chip-type surge absorbers of Comparative Example 1, the external size of the hermetic cap was set to 2.0 mm×1.4 mm×1.1 mm, and the internal size was set to 1.2 mm×0.6 mm×0.8 mm. One pair of discharge electrodes with a width of 300 m was formed in each sample. Separation grooves were formed on the surface opposite to the surface on which the discharge electrodes were formed. The other conditions were same as those in Example 1.

One hundred samples of each of Example 1 and Comparative Example 1 were evaluated in terms of the surge resistance.

The mean surge resistance of the samples of Example 1 was 300 A, and that of Comparative Example 1 was 50 A. Thus, it turned out that the chip-type surge absorber according to the present invention has a greater surge resistance than the conventional chip-type surge absorber.

Second Embodiment

Figure 2A:
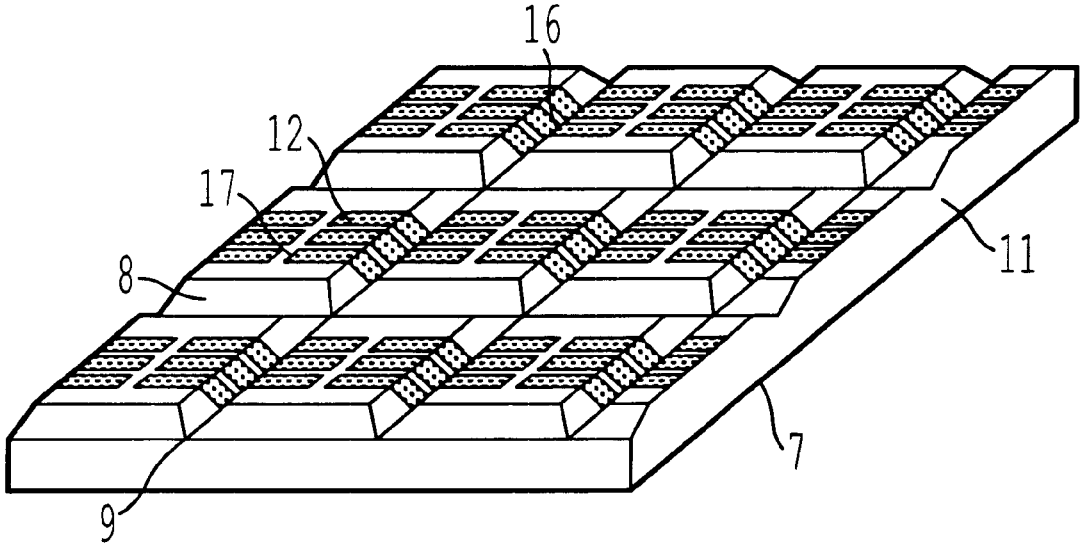
FIG. 2A is a perspective view illustrating a second embodiment of a chip-type surge absorber and a production method thereof, according to the present invention, wherein an insulating sheet, separation grooves, discharge electrodes, and discharge gaps are shown.

Referring to FIG. 2, a second embodiment of a chip-type surge absorber according to the present invention and a production method thereof are described below. Of the constituent elements of the chip-type surge absorber 20 and elements used in production thereof according to the present embodiment, elements which are the same as or similar to those used in the first embodiment are denoted by similar reference numerals and they are not described in further detail herein.

Figure 2B:
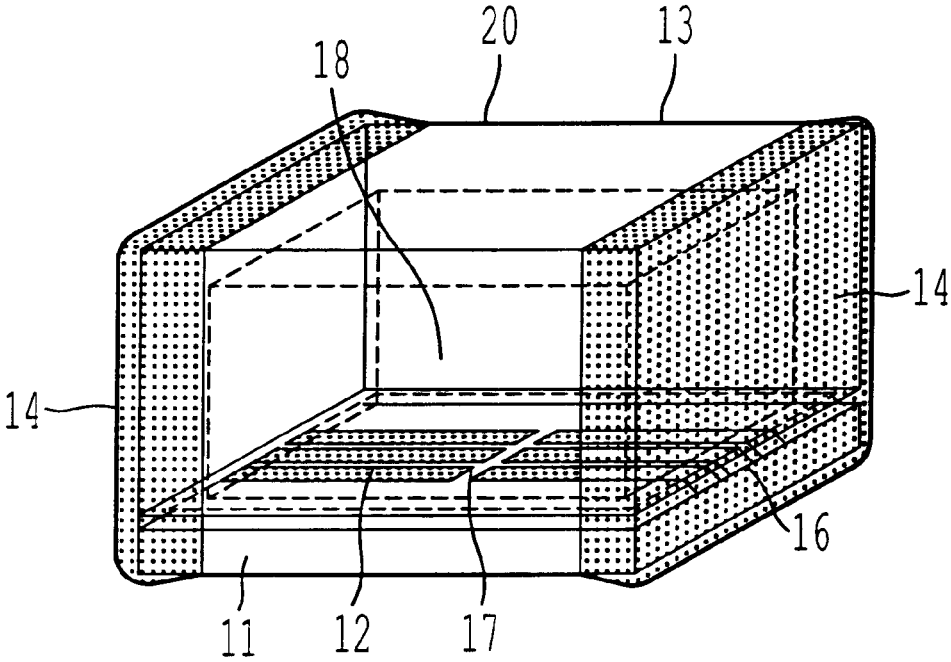
FIG. 2B is a perspective view illustrating the chip-type surge absorber in the complete form according to the second embodiment of the present invention.

In this second embodiment, as shown in FIG. 2B, the chip-type surge absorber 20 includes a insulating substrate in the shape of a rectangular parallelepiped; an insulating hermetic cap 13 open at a bottom side thereof, for forming, together with the insulating substrate, 11 a box-shaped hermetically sealed cavity 18 filled with a discharge gas; terminal electrodes 14 disposed at both ends of the hermetically sealed cavity 18, two to five pairs of discharge electrodes 12 which are formed in the hermetically sealed cavity 18 such that a discharge gap 17 is formed between each pair of discharge electrodes 12 and such that the discharge electrodes 12 are electrically connected to the corresponding terminal electrodes 14, and connection surfaces 16 for increasing the connection area for the connection between the discharge electrodes 12 and the terminal electrodes 14.

The chip-type surge absorber 20 having the structure described above may be produced by a production method similar to that for the chip-type surge absorber 10 according to the first embodiment except that a conductive film for the discharge electrodes 12 is formed such that two to five pairs of discharge electrodes 12 have the shape of wide stripes and such that the discharge electrodes 12 also extend over the connection surfaces. The width of the stripes and the space between the stripes are determined depending upon the width of the insulating substrate 11 and the number of stripes. The upper limit of the number of pairs of discharge electrodes 12 is five, because a further increase in the number of pairs of discharge electrodes 12 results in no effects.

In the chip-type surge absorber 20 constructed in the above-described manner, the discharge electrodes 12 extend into the connection surfaces 16 where the discharge electrodes 12 are overlapped with the terminal electrodes 14 thereby assuring good electrical connection. This allows the hermetic cap 13 to be disposed such that the ends of the hermetic cap 13 become flush with the corresponding ends of the insulating substrate 11, thereby allowing an increase in the volume of the hermetically sealed cavity 18 and thus enhancing the surge resistance. Good electrical connection between the discharge electrodes 12 and the terminal electrodes 14 can be obtained even when there are a large number of pairs of discharge electrodes 12. In the chip-type surge absorber 20 according to the present embodiment, a plurality of points where an electric field is concentrated are formed between the two to five pairs of discharge electrodes 12. This assures that discharging is triggered by a surge applied to the surge absorber 20 without a delay.

Another advantage of the chip-type surge absorber 20 is that it is symmetrical in shape in a vertical direction and thus it is not necessary to distinguish which is an upper side or which is a lower side when the chip-type surge absorber 20 is mounted on a circuit board or the like.

The performance of the chip-type surge absorber 20 according to the present embodiment has been compared with that of a conventional chip-type surge absorber.

Chip-type surge absorbers according to the above-described production method of the present invention were produced using an insulating sheet of mullite with a size of 128 mm×64 mm×0.5 mm thereby obtaining samples of Example 2.

In Example 2, the chip-type absorbers formed on the insulating sheet were separated into individual pieces each having a size of 3.2 mm×1.6 mm×0.5 mm.

Three pairs of discharge electrodes each having a width of 100 μm were formed of a TiN film with a thickness of 1 μm such that adjacent electrodes were spaced 50 μm, and the discharge gaps were formed so as to have a gap distance of 30 μm.

The hermetic cap was formed of mullite so as to have an external size of 3.2 mm×1.6mm×1.1 mm and an internal size of 2.4 mm×0.8 mm×0.8 mm. The terminal electrodes were formed of an Ag/Pd alloy, and Ar was employed as the discharge gas. The discharge gas was enclosed at a pressure of $6.65\times10^4$ Pa.

Chip-type surge absorbers 150 having the structure shown in FIG. 14 were also produced thereby obtaining samples denoted herein as Comparative Example 2.

In the samples of the chip-type surge absorbers of Comparative Example 1, the external size of the hermetic cap was set to 2.0 mm×1.4 mm×1.1 mm, and the internal size was set to 1.2 mm×0.6 mm×0.8 mm. One pair of discharge electrodes with a width of 300 μm was formed in each sample. Separation grooves were formed on the surface opposite to the surface on which the discharge electrodes were formed. The other conditions were same as those in Example 2.

Furthermore, samples of chip-type surge absorbers of Comparative Example 3 were produced in a similar manner to Comparative Example 2 except that the size of the hermetic cap was set to be equal to that of Example 2 and the terminal electrodes were produced in a similar manner to those of Example 2.

Samples of chip-type surge absorbers of Comparative Example 4 were also produced in a similar manner to Example 2 except that each sample has one pair of discharge electrodes with a width of 300 μm.

A first experiment was performed using one hundred samples for each of Example 2 and Comparative Example 2 to evaluate the surge resistance thereof.

The mean surge resistance of the samples of Example 2 was 300 A, and that of Comparative Example 2 was 50 A. Thus, it turned out that the chip-type surge absorber according to the present embodiment has a greater surge resistance than the conventional chip-type surge absorber.

A second experiment was also performed using one hundred samples for each of Example 2, Comparative Example 3, and Comparative Example 4. In this second experiment, a voltage of 500 V was applied to each sample for 1.2/50 μs to evaluate the discharge start time.

The measured discharge start times were 0.5 μs, 2 μs, and 2 μs for Example 2, Comparative Example 3, and Comparative Example 4, respectively. This result indicates that the chip-type surge absorber according to the present embodiment has a shorter discharge start time than Comparative Examples 3 and 4. In three samples of chip-type surge absorbers of Comparative Example 3, no discharge was observed. A probable cause is a connection failure between the terminal electrodes and the discharge electrodes.

Third Embodiment

Figure 3:
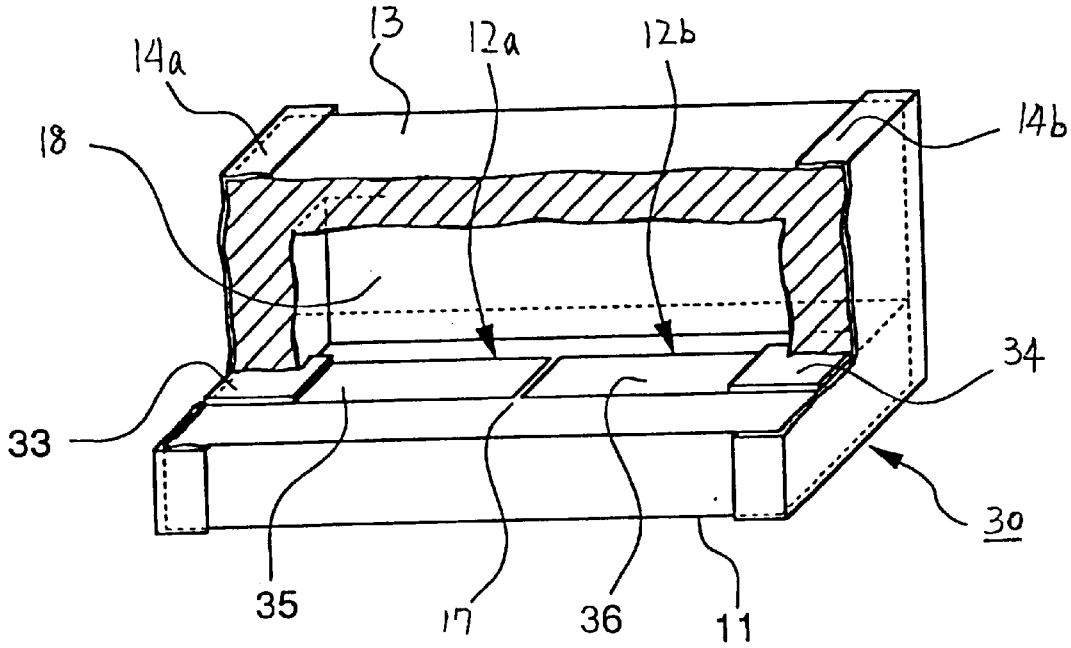
FIG. 3A is a perspective view generally illustrating a third embodiment of a chip-type surge absorber according to the present invention.
Figure 4:
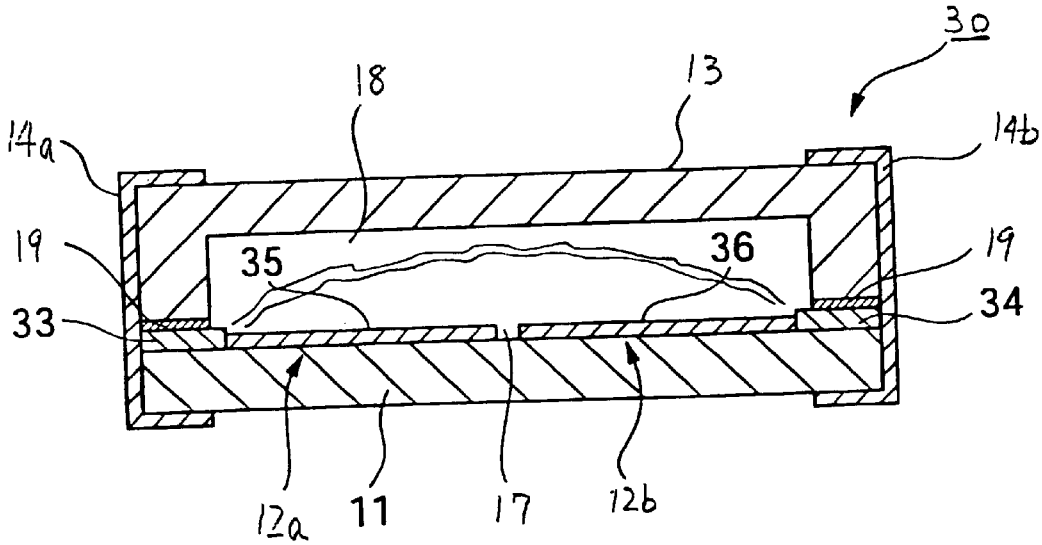
FIG. 4 is a longitudinal sectional view of FIG. 3.

Referring to FIGS. 3 and 4, a third embodiment of a chip-type surge absorber according to the present invention is described below. FIG. 3 is a perspective view generally illustrating the chip-type surge absorber according to the present embodiment, and FIG. 4 is a longitudinal sectional view thereof. Of the constituent elements of the chip-type surge absorber 30 according to the present embodiment, elements which are the same as or similar to those used in the first or second embodiment are denoted by similar reference numerals and they are not described in further detail herein.

In the present embodiment, the chip-type surge absorber 30 includes an insulating substrate 11 made of alumina or a similar material, discharge electrodes 12*a* and 12*b* formed on the insulating substrate 11, and a discharge gap 17 with a predetermined gap distance formed between the discharge electrodes 12*a* and 12*b*.

Furthermore, as shown in FIG. 3, an electrically insulating hermetic cap 13 made of glass is placed upon the insulating substrate 11 on which the discharge electrodes 12*a* and 12*b* and the discharge gap 17 are formed. The hermetic cap 13 is adhesively bonded to a peripheral part of the insulating substrate 11 using an electrically insulating glass adhesive such that the discharge electrodes 12*a* and 12*b* and the discharge gap 17 in the hermetically sealed space 18 formed in the hermetic cap 13 are exposed to a gas ambient in the hermetically sealed space 18.

In the chip-type surge absorber 30, as shown in FIG. 4, the outer-side ends of the respective discharge electrodes 12*a* and 12*b* extend to the end faces of the insulating substrate 11 and the hermetic cap 13 via a bonding region 19 such that the discharge electrodes 12*a* and 12*b* are connected to respective terminal electrodes 14*a* and 14*b* disposed on the respective end faces of the insulating substrate 11 and the hermetic cap 13.

Outer-side end parts 33 and 34 of the respective discharge electrodes 12*a* and 12*b* are formed, in the bonding region 19 where the hermetic cap 13 and the insulating substrate 11 are bonded to each other, using a material having a lower resistance than the resistance of the material of inner-side end parts 35 and 36 of the discharge electrodes 12*a* and 12*b*, such that the outer-side end parts 33 and 34 have a greater thickness than the inner-side end parts 35 and 36 and such that the outer-end parts 33 and 34 slightly extend into the hermetically sealed cavity 18 enclosed by the hermetic cap 13.

The discharge electrodes 12*a* and 12*b* may be produced as follows. A stripe of a conductive metal such as nickel is first formed by means of sputtering, evaporation, or printing. The central part of the nickel film is then illuminated with a laser beam so as to remove the central part thereby cutting off the nickel film and thus forming the inner-side end parts 35 and 36 and the discharge gap 17 between the inner-side end parts 35 and 36. A film of a conductive material having a low resistance such as Cu, Al, Ag, Au or Pt is then formed by means of printing in areas at the outer ends of the respective inner-side end parts 35 and 36 such that each film is electrically connected to the corresponding inner-side end part 35 or 36 thereby obtaining the outer-side end parts 33 and 34. The discharge electrodes 12*a* and 12*b* are formed such that the inner-side end parts 35 and 36 have a thickness of 2 to 20 μm and the outer-side end parts 33 and 34 have a thickness of 5 to 50 μm.

When a surge voltage is applied to the chip-type surge absorber 30 constructed in the above-described manner, a glow discharge is started between the inner-side end parts 35 and 36 of the discharge electrodes 12*a* and 12*b* via the discharge gap 17. The glow discharge grows into a creeping discharge toward the outer-side end parts 33 and 34 of the discharge electrodes 12*a* and 12*b*, and, finally, an arc discharge occurs between the outer-side end parts 33 and 34, thereby absorbing the surge voltage.

During the arc discharge, an arc discharge current flows via a particular point of each outer-side end part 33 and 34 into the outer-side end parts 33 and 34 of the discharge electrodes 12*a* and 12*b*. However, because the outer-side end parts 33 and 34 of the discharge electrodes 12*a* and 12*b* have a large thickness and a low resistance, the arc current is spread out, and thus the current density of the arc current is reduced and the increase in temperature is suppressed. In particular, the large thickness of the outer-side end parts 33 and 34 allows the arc current to be efficiently spread out from the input point.

Therefore, unlike the conventional surge absorbers, the adhesive is prevented from being melted by high temperature. Furthermore, it becomes possible to prevent the hermetic cap 13 made of glass from being opened by a surge voltage, and thus the durability to surge voltages is improved. Thus, the surge resistance is improved.

In the present embodiment, as described above, because the outer-side end parts of the discharge electrodes 12*a* and 12*b* are formed so as to have a large thickness and so as to slightly extend into the hermetically sealed cavity 18 enclosed by the hermetic cap 13, as shown in FIG. 4, the inner ends of the respective outer-side end parts 33 and 34 make it easier for the arc discharge to start and to be maintained in a stable fashion.

In the case of the chip-type surge absorber with the outer-side end parts 33 and 34 of the discharge electrodes 12*a* and 12*b* formed of a material having a sheet resistance of 0.1 Ω/□ so as to have a width of 0.3 mm and a thickness of 20 μm, a surge resistance of 200 A (8/20 μsec) can be obtained. In the case where the outer-side end parts 33 and 34 are formed of the same material so as to have a width of 0.3 mm and a thickness of 50 μm, a surge resistance of 500 A ((8/20 μsec) can be obtained. In any case, the surge resistance is greatly increased compared with that achieved by the conventional surge absorbers.

Because it is required only to partially increase the thickness of each discharge electrode 12*a* and 12*b*, the outer-side end parts 33 and 34 of the present embodiment can be easily formed by means of the printing technique.

In this specific embodiment described above, the inner-side end parts 35 and 36 of the discharge electrodes 12*a* and 12*b* are made of nickel, and the outer-side end parts 33 and 34 are made of a material such as Cu, Al, or Au. However, the materials are not limited to those described above. Other materials having a low resistance such as Ti, W, or Mo may also be employed, depending upon the desired discharging characteristics.

Furthermore, although the outer-side end parts 33 and 34 are formed using a low-resistance material so as to have a greater thickness than the inner-side end parts 35 and 36, what is essential to the present embodiment is that the outer-side end parts 33 and 34 have a low resistance. Therefore, the purpose can be achieved either by employing a material having a low specific resistance or by increasing the thickness of the material. The resistance may also be decreased by increasing the width instead of increasing the thickness. However, the arc current tends to spread more easily in the thickness direction in the width direction, and thus the increase in the thickness of more effective than the increase in the width.

Although the hermetic cap is made of glass, the material is not limited glass. Other insulating materials may also be employed.

Fourth Embodiment

Figure 5A:
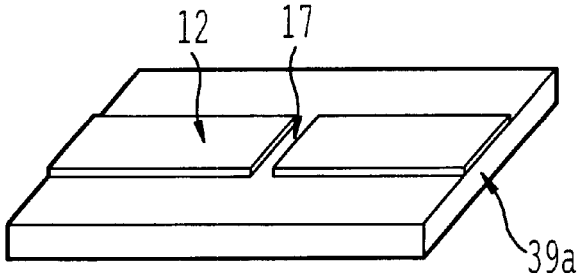
FIG. 5A is a schematic diagram illustrating a discharge substrate being in process for production of a chip-type surge absorber according to a fourth embodiment of the present invention.
Figure 5B:
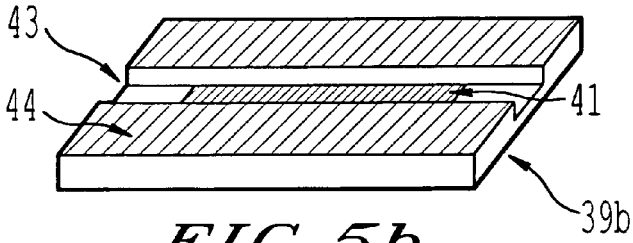
FIG. 5B is a schematic diagram illustrating a cover substrate being in process for production of the chip-type surge absorber according to the fourth embodiment of the present invention.
Figure 5C:
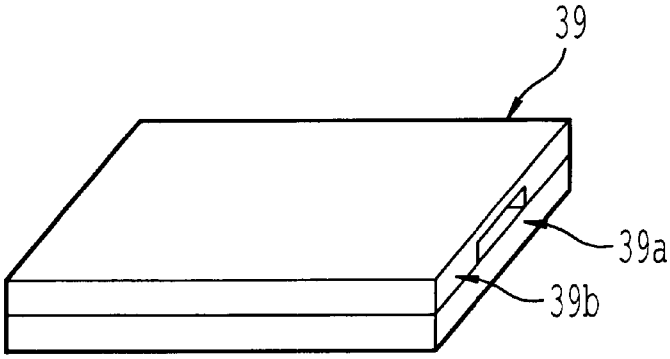
FIG. 5C is a schematic diagram illustrating the discharge substrate and the cover substrate combined together in the process for production of the chip-type surge absorber according to the fourth embodiment of the present invention.
Figure 5D:
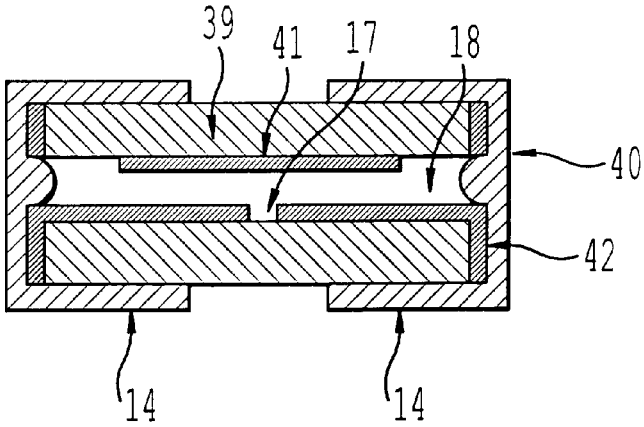
FIG. 5D is a longitudinal sectional view of the chip-type surge absorber according to the fourth embodiment of the present invention.
Figure 6:
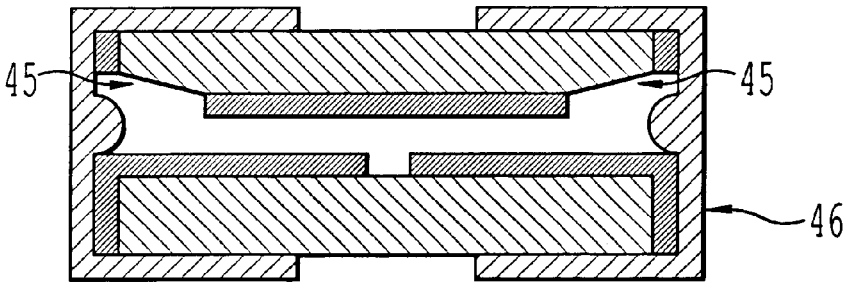
FIG. 6 is a longitudinal sectional view of a modification of the chip-type surge absorber according to the fourth embodiment of the present invention.
Figure 15A:
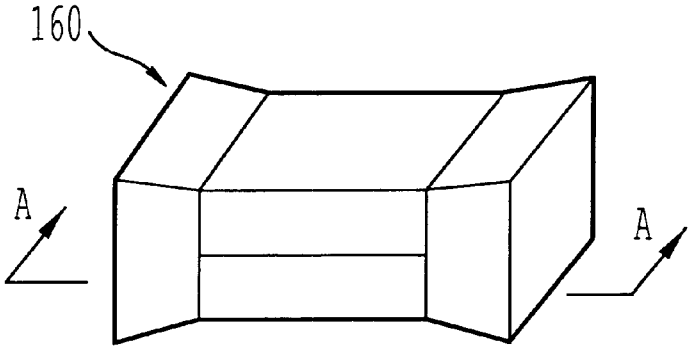
FIG. 15a PRIOR ART
FIG. 15A is a perspective view illustrating still another example of a conventional chip-type surge absorber.
Figure 15B:
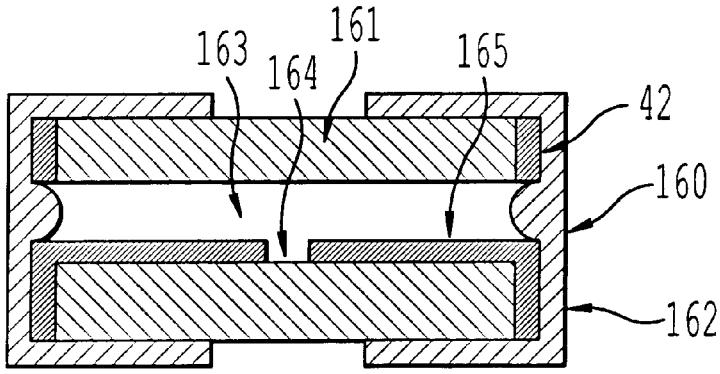
FIG. 15B is a cross-sectional view taken along line A—A of FIG. 15A.

Referring to FIGS. 5 and 6, a fourth embodiment of a chip-type surge absorber according to the present invention is described below. FIG. 5 illustrates the process of producing a chip-type surge absorber according to the fourth embodiment, wherein FIG. 5A illustrates a discharge substrate 39*a* and FIG. 5B illustrates a cover substrate 39*b*, wherein the discharge substrate 39*a* and the cover substrate 39*b* form an insulating substrate 39. FIG. 5C illustrates the discharge substrate 39*a* and the cover substrate 39*b* combined together. FIG. 5D is a cross-sectional view of the chip-type surge absorber 40 of the present embodiment. Of the constituent elements of the chip-type surge absorber 40 according to the present embodiment, elements which are the same as or similar to those used in the first to third embodiment are denoted by similar reference numerals and they are not described in further detail herein.

The chip-type surge absorber 40 according to the present embodiment includes an insulating substrate 39 in the shape of a rectangular parallelepiped having a cavity extending through the insulating substrate 39, a pair of terminal electrodes 14 which are disposed on the respective ends of the insulating substrate 39 such that the above-described cavity is closed by the terminal electrodes 14, a hermetically sealed cavity 18 which is enclosed by the insulating substrate 39 and the terminal electrodes 14 and which is filled with a discharge gas, and a pair of discharge electrodes 12 which are formed within the hermetically sealed cavity 18 and on the insulating substrate 39 such that a discharge gap 17 is formed between the discharge electrodes 12, wherein the terminal electrodes 14 are electrically connected to the corresponding discharge electrodes 12. On the inner surface, opposite to the insulating substrate 39, of the hermetically sealed cavity 18, there is provided a relay terminal 41 isolated from the discharge electrodes 12 and the terminal electrodes 14, for relaying an arc discharge.

In the chip-type surge absorber 40 constructed in the above-described manner, if an arc discharge occurs between the terminal electrodes 14 due to a long-period surge, the inside of the hermetically sealed cavity 18 is raised to a high temperature. In the present embodiment, the relay electrode 41 disposed at a location isolated from the discharge electrodes 12 and the terminal electrodes 14 allow the arc discharge to partially occur via the relay electrode 41. As a result, the arc discharge partially occurs between the relay electrode 41 and the terminal electrodes 14, and thus the amount of discharge between the discharge electrodes 12 is reduced. This results in a reduction in the amount of discharge between the discharge electrodes 12. Therefore, a great reduction in the heat load upon the discharge electrodes 12 is achieved. As a result, the discharge gap 17 has high resistance against a large number of surges applied to the discharge gap 17, and thus the chip-type surge absorber 40 has a long life.

Furthermore, the inner end portions of the insulating substrate 39 in the hermetically sealed cavity 18 are partially cut out in an inward direction between the ends of relay electrode 41 and the terminal electrodes 14, so as to expand the discharge space. The reason for this is that the expansion of the discharge space makes it possible for an arc discharge to easily occur between the relay electrode 41 and the terminal electrodes 14. Furthermore, the expansion of the discharge space prevents the chip-type surge absorber from having a short-circuit failure which would otherwise occur due to deposition of metal evaporated by the arc discharge onto the end parts of the insulating substrate 39.

As described above, the insulating substrate 39 of the present embodiment is exposed to a high temperature when a surge is applied. Therefore, the insulating substrate 39 is required not only to be electrically insulating but also to have high heat resistance. In this regard, ceramic has excellent heat resistance and is a preferable material for the insulating substrate 39. Among various kinds of ceramic, alumina and mullite are most preferable in general respects including the electric insulation, heat resistance, mechanical strength, and cost.

The insulating substrate 39 is formed in the shape of a rectangular parallelepiped having a cavity extending through it. The insulating substrate 39 may be produced by hollowing a block of an insulating material. However, the problem of this technique is the difficulty in forming the discharge gap 17 and the relay electrode 41. A more preferable method to produce the insulating substrate 39 is to adhesively bond two plates, one of or both of which have a groove 43, to each other into a laminated form.

The terminal electrodes 14 are produced by covering the ends of the insulating substrate 39 with a metal material of the metal caps and performing baking. The material for the hermetic metal caps may be a conductive paste containing a noble metal such as Ag, Ag/Pd, Ag/Pt, or Cu.

The cavity of the insulating substrate 39 is closed when the terminal electrodes 14 are formed in the above-described manner. In order to fill the enclosed cavity with a discharge gas, the formation of the terminal electrodes 14 is performed in an ambient of the discharge gas. After enclosing the discharge gas within the discharge gas, the cavity serves as the hermetically sealed cavity 18.

Because of the small thickness of the discharge electrodes 12, it is difficult to make electrical connection between the discharge electrodes 12 and the terminal electrodes 14. To facilitate the electrical connection, an auxiliary connection electrode 42 may be formed on each end of the insulating substrate 39 as shown in FIG. 5D.

To meet the requirement that the discharge electrodes 12 should have high heat resistance, the discharge electrodes 12 are preferably made of conductive ceramic or metal. More specifically, the discharge electrodes 12 are formed using $RuO_2$, Ti, TiO, Ta, W, SiC, $SnO_2$, BaAl, Nb, Si, C, Au, Ag, Pt, Pd, or La or a mixture of two or more of these, by means of sputtering, evaporation, ion plating, or printing. The thickness of the discharge electrodes 12 is selected within the range from 0.1 to 20 $\mu$m.

The discharge gap 17 may be formed by first forming one stripe of discharge electrode material and then cutting it using a laser or by means of etching. Alternatively, the discharge gap 17 may also be formed at the same time as the conductive film by means of the screen mask method or the like. The number of discharge gaps 17 is not limited to one, and a plurality of discharge gaps may be formed. When a plurality of discharge gaps are formed, the discharge start voltage is determined by the sum of the gap distances. It is required that the minimum space between the discharge electrodes 12 and the relay electrode 41 should be greater than the sum of the gap distances of the discharge gaps 17. If the minimum space between the discharge electrodes 12 and the relay electrode 41 is smaller than the sum of the gap distances, a discharge will start between the discharge electrodes 12 and the relay electrode 41.

Various kinds of gases which are ionized at high temperatures, such as air, may be employed as the discharge gas. In order to achieve good stability at high temperatures and to obtain a desired discharge start voltage, it is preferable to use one gas or a mixture of two or more gasses selected from the group consisting of He, Ar, Ne, Xe, SF6, $CO_2$ $H_2$, $C_2F_6$, $C_3F_8$, $CF_4$, and $N_2$.

The relay electrode 41, which is a feature of the chip-type surge absorber 40 of the present embodiment, is made of the same material as that of the discharge electrodes 12. The purpose of the relay electrode 41 can be achieved by forming it not only on the bottom of the groove 43 but also on the side walls of the groove 43. The shape of the relay electrode 41 may be freely selected unless the space from the discharge electrodes 12 or the terminal electrodes 14 is too small. The relay electrode 41 may be formed using a production method such as printing or sputtering in a similar manner to the formation of the discharge electrodes 12.

Samples of chip-type surge absorbers 40 were produced in accordance with the method shown in FIG. 5 (herein, those samples are referred to as sample of Example 4a). Note that the present invention is not limited to the details of Example 4a described herein. In Example 4a, the insulating substrate 39 was made of alumina, the terminal electrodes 14 was made of Cu, and the discharge electrodes 12 and the relay electrodes 41 were made of $RuO_2$.

(1) A film for the discharge electrodes 12 was formed on an insulating plate by means of printing. The film was then cut by a laser so as to form a discharge gap 17 with a gap distance of 20 $\mu$m, thereby forming a discharge substrate 39*a*. The size of the discharge substrate 39*a* was set to 3.2 mm×1.6 mm×0.5 mm, and the size of the discharge electrodes 12 was set to 1.6 mm (in length)×0.5 mm (in width)×5 $\mu$m (in thickness).

(2) A groove 43 with a width of 0.5 mm and a depth of 0.25 mm, to be used to form the hermetically sealed cavity 18, was formed in the insulating substrate 39. A relay electrode 41 with a width of 0.48 mm, a length of 2.2 mm, and a thickness of 5 $\mu$m was then formed, using a printing method, on the bottom of the groove 43, thereby forming a cover substrate 39*b*. The size of the cover substrate 39*b* was set to 3.2 mm×1.6 mm×0.5 mm.

(4) The discharge substrate 39*a* and the cover substrate 39*b* were combined together via a glass paste 44 and subjected to heating so as to form an insulating substrate 39.

(5) The ends of the insulating substrate 39 was covered with a hermetic metal cap and then baked so as to form terminal electrodes 14. In this process, an auxiliary electrode 42 may be first formed and then the terminal electrodes 14 may be formed, as shown in FIG. 5D, so as to assure good electrical connection between the discharge electrodes 12 and the terminal electrodes 14.

(6) The baking after the formation of the terminal electrodes 14 was performed in an ambient of a flow of Ar gas at a pressure of $10.1\times10^4$ Pa so that the hermetically sealed cavity 18 was filled with the discharge gas when the terminal electrodes 14 were formed.

Thus, the production of the chip-type surge absorber in Example 4a was completed.

Referring to FIG. 6, another example of a chip-type surge absorber according to the present embodiment is described below. This chip-type surge absorber 46 can be obtained by modifying the chip-type surge absorber 40 such that the insulating substrate 39 is partially cut out between the ends of the relay electrode 41 and the terminal electrodes 14 so as to form cutouts 45 thereby expanding the discharge space. The partial cutting of the insulating substrate 39 may be performed using a laser or a dicing technique.

The chip-type surge absorber 46 is characterized in that the inner end portions, between the ends of the relay electrode 41 and the terminal electrodes 14, of the insulating substrate 39 are cut out so as to expand the discharge space. More specifically, in the above-described process (3) of the production of the chip-type surge absorber 40, after forming the relay electrode 41, the depth of the groove 43 (not shown in FIG. 6) is increased using a laser, from each end of the relay electrode 41 toward the corresponding end of the groove 43 so as to form the cutouts 45 thereby expanding the discharge space (refer to FIG. 6). In this specific example, the depth of the groove 43 is increased by 0.1 mm as measured at the ends of the insulating substrate 39. (Samples obtained herein are referred to as samples of Example 4b.) In the case where the chip-type surge absorber includes the auxiliary electrodes 42, the auxiliary electrodes 42 may also be partially cut out.

Preferably, the depth of the groove 43 increases toward the ends of the insulating substrate 39. However, if the discharge space is expanded, the depth is not necessarily required to be larger at the ends of the insulating substrate.

The cutting-out of the insulating substrate 39 may be performed before the formation of the relay electrode 41.

Samples of Examples 4a and 4b according to the present embodiment were evaluated relative to the conventional chip-type surge absorber.

Samples of the conventional chip-type surge absorbers were produced so as to have a similar structure to that of Example 4a except that no relay electrode was formed on the cover substrate (these samples are herein referred to as samples of Comparative Example 5).

The life test was performed for samples of chip-type surge absorbers of Example 4a, Example 4b, and Comparative Example 5. Note that samples were formed so as to have a gap distance of 20 $\mu$m, an initial discharge start voltage of 300 V, and Ar gas filled at a pressure of $10.1\times10^4$ Pa was employed as the discharge gas.

The life test was performed as follows. After charging a 1500 pF capacitor to a voltage of 10 kV, the charged voltage was applied to samples of the chip-type surge absorbers. The voltage was applied 1500 times to each sample, and the discharge start voltage was measured every 500th application of surge. The life test was performed for seven samples of each of Example 4a, Example 4b, and Comparative Example 5, and the mean values were calculated.

The result is shown in the form of a table in FIG. 7.

As can be seen from FIG. 7, an increase in the discharge start voltage was observed for the samples of the conventional chip-type surge absorbers of Comparative Example 5. In contrast, no increase in the discharge start voltage was observed after the application of 1000 surges for the samples of the chip-type surge absorbers of Example 4a according to the present embodiment, and after the application of 1500 surges for the samples of Example 4b.

The result of the life test indicates that, in the chip-type surge absorber according to the present embodiment, the relay electrode 41 disposed on the inner surface opposite to the discharge gap 17 allows the arc discharge current to partially flow through the relay electrode 41 and thus the arc discharge partially occurs between the relay electrode 41 and the terminal electrodes 14, which results in a reduction in the heat load upon the discharge electrodes 12 and a reduction in thermal damage to the discharge gap 17 and thus an increase in the life.

The expanded discharge spaces between the relay electrode 41 and the terminal electrodes 14 makes it possible for an arc discharge to easily occur, which results in an increase in the life of the chip-type surge absorber. Furthermore, the expanded discharge spaces prevent the chip-type surge absorber from having a short-circuit failure which would otherwise occur due to deposition of metal evaporated by the arc discharge onto the end parts of the insulating substrate 39.

Fifth Embodiment

Figure 8:
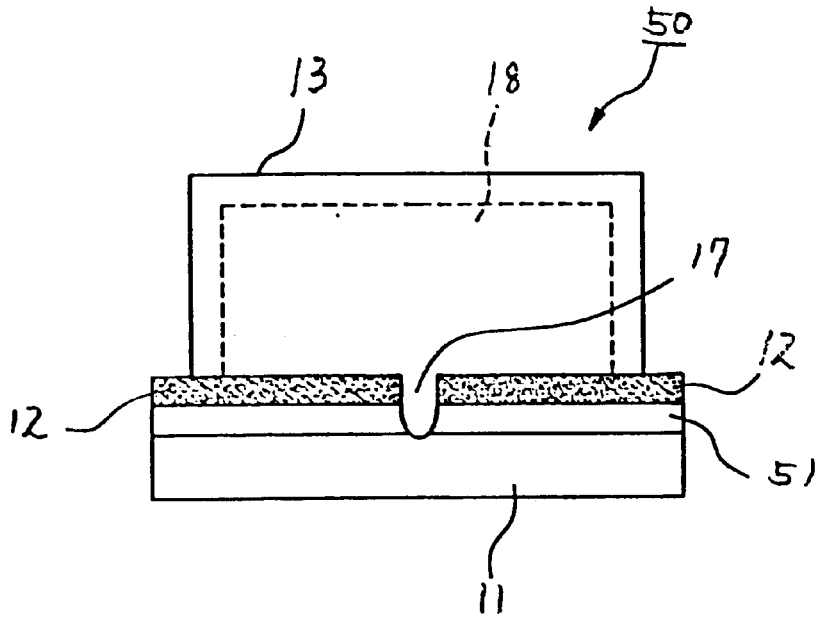
FIG. 8 is a side view illustrating main parts of a chip-type surge absorber according to a fifth embodiment of the present invention.
Figure 9:
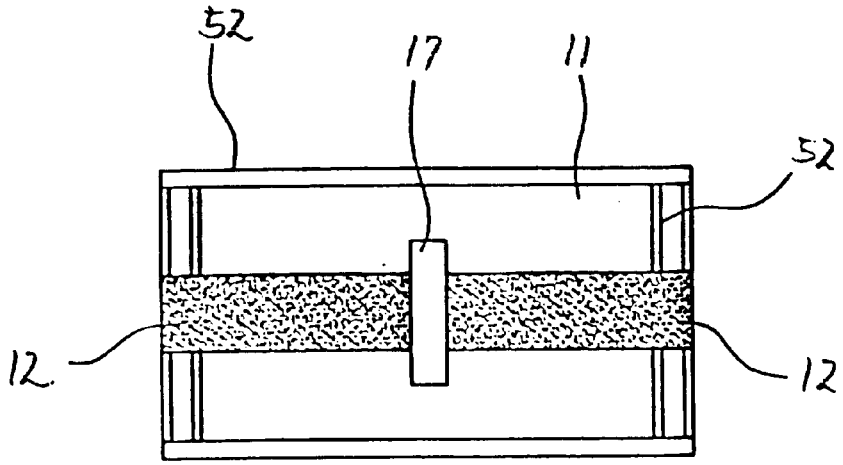
FIG. 9 is a plan view of chip-type surge absorber shown in FIG. 8.

Referring to FIGS. 8 and 9, a fifth embodiment of a chip-type surge absorber according to the present invention and a production method thereof are described below. FIG. 8 is a side view illustrating main parts of the chip-type surge absorber according to the present embodiment, and FIG. 9 is a plan view thereof. Of the constituent elements of the chip-type surge absorber 50 according to the present embodiment, elements which are the same as or similar to those used in the first to fourth embodiment are denoted by similar reference numerals and they are not described in further detail herein.

A stripe-shaped insulating layer 51 having heat resistance lower than that of the insulating substrate 11 is formed on the insulating substrate 11 having high heat resistance. The insulating layer 51 having low heat resistance is cut together with the material of the discharge electrodes which will be described later so that the insulating layer 51 and the discharge electrode material are separated at the center in the longitudinal direction into two pieces (on the left and right sides in FIG. 8). A pair of the discharge electrodes 12 are formed on the upper surface of the insulating layer 51 having low heat resistance such that a discharge gap 17 is formed between the discharge electrodes 12. The discharge electrodes 12 are spaced together with the insulating layer 51 having low heat resistance from each other by the discharge gap 17 at the center in the longitudinal direction. That is, the insulating layer 51 having heat resistance lower than that of the insulating substrate 11 is formed between the insulating substrate 11 and the discharge electrodes 12.

The insulating substrate 11 is made of an insulating material which can provide hermeticity. Specific examples of the preferable material include alumina, corundum, mullite, and mixtures thereof. The insulating layer 51 having low heat resistance is preferably made of an insulating material which can be easily cut using a laser, that is, an insulating material having low optical reflectance, low optical transmittance, and low heat resistance. A specific example of such a material is MgO. The discharge electrodes 12 are preferably formed using one material selected from the group consisting of $RuO_2$, Ti, TiO, TiN, Ta, W, SiC, $SnO_2$, BaAl, Si, C, Pd, Pt, Au, Ag, V, Al, La, and Nb or a combination of two or more materials selected of the group.

The substrate surface of the insulating substrate 11 is formed so as to be flat. The insulating layer 51 having low heat resistance is formed on the flat substrate surface of the insulating substrate 11. The discharge electrodes 12 are disposed on the insulating layer 51 into a multilayer structure. Therefore, the discharge electrodes 12 are raised by the insulating layer 51 from the surface of the insulating substrate 11 to a height equal to the thickness of the insulating layer 51 having low heat resistance.

Although in this specific embodiment, the discharge electrodes 12 are raised from the insulating substrate 11 to the height equal to the thickness of the insulating layer 51 having low heat resistance, the discharge electrodes 12 are not necessarily required to be raised by an amount equal to the thickness of the insulating layer 51 having low heat resistance, if the insulating layer 51 having low heat resistance is formed between the insulating substrate 11 and the discharge electrodes 12. For example, a stripe-shaped groove may be formed in the insulating substrate 11, and the insulating layer 51 having low heat resistance may be embedded in the groove. Furthermore, the discharge electrodes 12 may be formed on the insulating layer 51 having low heat resistance, whose surface is flush with the surface of the insulating substrate 11, into a multilayer structure.

This structure allows a deep discharge gap to be formed without causing a reduction in the volume of the space enclosed by the hermetic cap, which will be described later.

The discharge gap 17 is formed such that at least both the material of the discharge electrode 12 and the insulating layer 51 having low heat resistance are completely separated into two portions. In this process, the insulating substrate 11 may be partially cut out in its depth direction. That is, the discharge gap 17 has a total depth equal to the sum of the thickness of the discharge electrodes 12, the thickness of the insulating layer 51 having low heat resistance, and the depth of the undercut formed in the insulating substrate 11.

Figure 20:
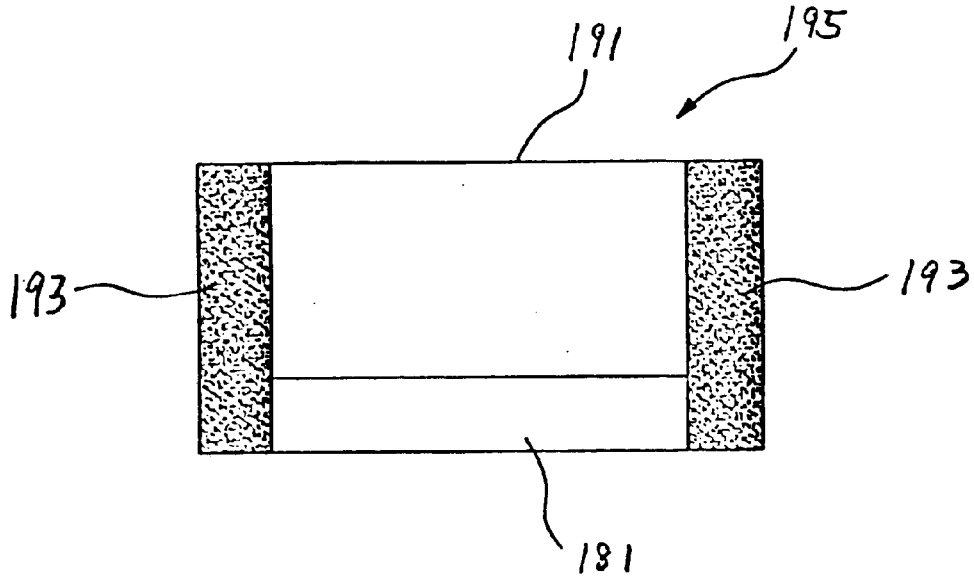
FIG.20 PRIOR ART
FIG. 20 is a side view illustrating another example of a conventional chip-type surge absorber.

A hermetic cap 13 similar to the conventional hermetic cap is adhesively bonded to the upper surface of the insulating substrate 11, on which the insulating layer 51 having low heat resistance and the discharge electrodes 12 are formed. The hermetic cap 13 has a hermetic cavity 18 and is bonded to the insulating substrate 11 such that the discharge gap 17 is located at the center of the hermetic cavity 18 and such that the far ends of the respective discharge electrodes 12 exposed to the outside of the hermetic cap 13. Terminal electrodes 193 (FIG. 20) similar to those according to the conventional technique are connected to the ends of the discharge electrodes 12 disposed to the outside of the hermetic cap 13, by means of baking or plating.

The chip-type surge absorber constructed in the above-described manner operates as follows.

In the chip-type surge absorber 50, because of the existence of the insulating layer 51 having heat resistance lower at least than the heat resistance of the insulating substrate 11 between the insulating substrate 11 and the discharge electrodes 12, the insulating layer 51 having low heat resistance is also deeply cut when the discharge gap 17 is formed by mean of laser cutting. This makes it possible to form the discharge gap 17 so as to have a large depth and a small gap distance. As a result, it becomes possible to obtain a low discharge start voltage, and it also becomes possible to prevent the discharge gap 17 from being filled with electrically conductive dust.

When the multilayer structure consisting of the discharge electrodes 12 and the insulating layer 51 having low heat resistance disposed on the substrate surface of the insulating substrate 11 is cut, the discharge gap 17 is formed at a location apart upward from the substrate surface by a distance equal to the thickness of the insulating layer 51 having low heat resistance, and an undercut is formed in the insulating layer 51 having low heat resistance at a location under the discharge gap 17 such that the undercut is open at both ends of the undercut. This ensures that the discharge gap 17 is open at both ends thereof even when the gap distance is small. Therefore, it becomes easy for electrically conductive dust to be exhausted from the discharge gap.

In the chip-type surge absorber 50 according to the present embodiment, as described above, it is possible to form the discharge gap 17 so as to have a small gap distance and a large depth, and thus it becomes possible to obtain a low discharge start voltage. Furthermore, this structure prevents the discharge gap 17 from being filled with electrically conductive dust. Thus, it is possible to achieve both low discharge start voltage and long life at the same time.

A method of producing the chip-type surge absorber 50 is described below.

A first step of producing the chip-type surge absorber 50 is to form a stripe-shaped insulating film 51 having low heat resistance on the substrate surface of an insulating substrate 11.

An electrically conductive film (material of the discharge electrodes 12) is then formed by means of printing, evaporation, or sputtering, such that the insulating film 51 having low heat resistance is covered with the electrically conductive film.

The electrically conductive film is then cut together with the insulating layer 51 by means of laser cutting in a direction perpendicular to the longitudinal direction such that the electrically conductive film is separated into a pair of discharge electrodes 12 and such that a discharge gap 17 is formed between the discharge electrodes 12. In this step, the insulating substrate 11 may be partially cut out, as described earlier.

Subsequently, a the hermetic cap 13 is placed on the insulating substrate 11 and bonded using an adhesive 52 such as a glass paste, such that a hermetically sealed cavity 18 is formed between the hermetic cap 13 and the insulating substrate 11.

The adhesively bonding of the hermetic cap 13 to the insulating substrate 11 is performed in atmospheric air or an gas ambient so that the hermetically sealed cavity 18 is filled with a desired gas (one gas or a mixture of two or more gasses selected from the group consisting of $N_2$, Ar, Ne, He, Xe, $H_2$, $SF_6$, $CF_4$, $C_2F_6$, $C_3F_8$, and $CO_2$).

After the bonding of the hermetic cap 13, terminal electrodes (similar to the terminal electrodes 193 shown in FIG. 20, although not shown in FIGS. 8 and 9) are formed on the parts of the discharge electrodes 12 exposed to the outside of the hermetic cap 13. More specifically, the terminal electrodes are formed by coating a metal paste, by means of dipping, on both end faces of the insulating substrate 11 and both end faces of the hermetic cap 13.

The terminal electrodes are then baked, and thus the production of the chip-type surge absorber 50 is completed.

In the method of producing the chip-type surge absorber 50, the insulating layer 51 having low heat resistance is formed on the insulating substrate 11, and the electrically conductive film formed on the insulating layer 51 having low heat resistance is cut together with the insulating layer 51 into two portions by means of laser cutting. Therefore, the insulating layer 51 having low heat resistance is cut deeply together with the electrically conductive film using a laser with low optical output power. Thus, it is possible to easily obtain a chip-type surge absorber 50 having a discharge gap 17 with a small gap distance and a large depth.

Samples of chip-type surge absorbers 50 were actually produced according to the production method described above, and the obtained samples were evaluated relative to the performance samples of chip-type surge absorbers produced according to the conventional production method.

The production conditions of the chip-type surge absorbers according to the present embodiment are as follows:

(1) Size of the insulating substrate: 3 mm×1.5 mm×0.5 mm (in thickness)

(2) Material of the insulating substrate: alumina (3) Thickness of insulating layer with low heat resistance: 10 $\mu$m (4) Material of the insulating layer with low heat resistance: MgO (5) Thickness of the discharge electrodes: 1 $\mu$m (6) Material of the discharge electrodes: Ti (7) Gap distance of the discharge gap: 7 $\mu$m (8) Depth of the undercuts of the discharge gap: 10 $\mu$m in the insulating layer with low heat resistance and 2 $\mu$m in the insulating substrate (12 $\mu$m in total)

(9) Enclosed gas: Ar (at a pressure of $1.06\times10^4$ Pa).

The production conditions of the chip-type surge absorbers of the comparative example are listed below:

(1) Size of the insulating substrate: 3 mm×1.5 mm×0.5 mm (in thickness)

(2) Material of the insulating substrate: alumina (3) Thickness of the discharge electrodes: 1 μm (4) Material of the discharge electrodes: Ti (5) Gap distance of the discharge gap: 11 μm (6) Depth of the undercut of the discharge gap: 3 μm in the insulating substrate (7) Enclosed gas: Ar (at a pressure of $1.06\times10^4$ Pa).

The result of the evaluation is described below.

The samples of the chip-type surge absorbers according to the present embodiment had a discharge start voltage of 150 V. The life test was also performed as follows. After applying a current surge of 50 A with a crest period of 8 μs and a tail period of 20 μs 1000 times, the insulation resistance was evaluated. The measured insulation resistance was greater than $10^9\Omega$ and no change in insulation resistance was observed.

In the samples of the chip-type surge absorbers of the comparative example, when the gap distance of the discharge gap was less than 10 μm, the resultant undercut in the insulating substrate had a depth less than 2 μm, which caused a short-circuit failure. To avoid the above problem, the discharge gap was formed to have a gap distance of 11 μm which resulted in formation of an undercut with a depth of 3 μm. The obtained samples had a discharge start voltage of 180 V. The life test was also performed in a similar as described above. A reduction in insulation resistance from $10^9\Omega$ was observed after application of 100 or less number of surges.

In the chip-type surge absorber 50 according to the present embodiment, as described above in detail, because the stripe-shaped insulating layer 51 having heat resistance lower at least than the heat resistance of the insulating substrate 11 is formed between the insulating substrate 11 and the discharge electrodes 12, the insulating layer 51 having low heat resistance is easily cut deeply when the small gap serving as the discharge gap 12 is formed by means of laser cutting. This makes it possible to form the discharge gap so as to have a small gap distance and a large depth. As a result, it becomes possible to obtain a low discharge start voltage, and it also becomes possible to prevent the discharge gap from being filled with electrically conductive dust. Thus, it is possible to achieve both low discharge start voltage and long life at the same time.

Sixth Embodiment

Figure 10:
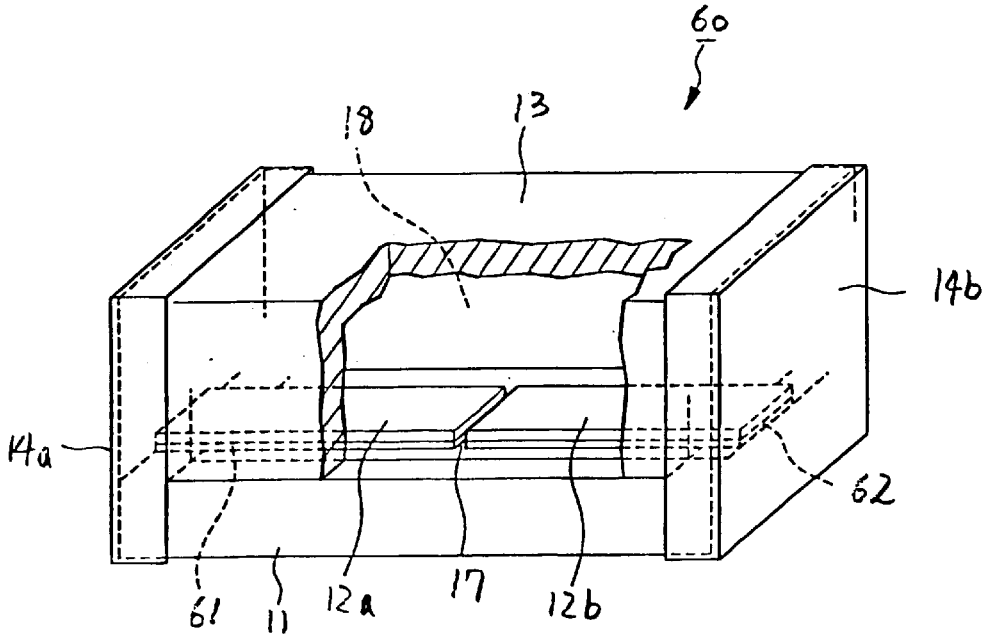
FIG. 10 is a perspective view generally illustrating a sixth embodiment of a chip-type surge absorber according to the present invention.
Figure 11:
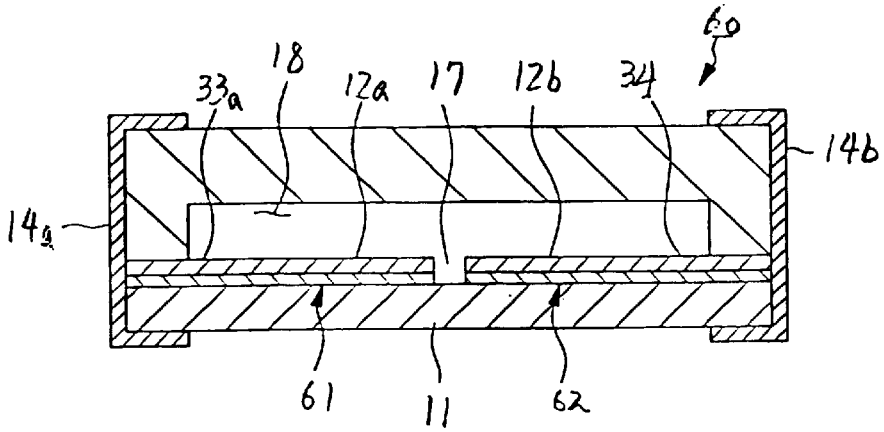
FIG. 11 is a longitudinal sectional view of FIG. 10.
Figure 12:
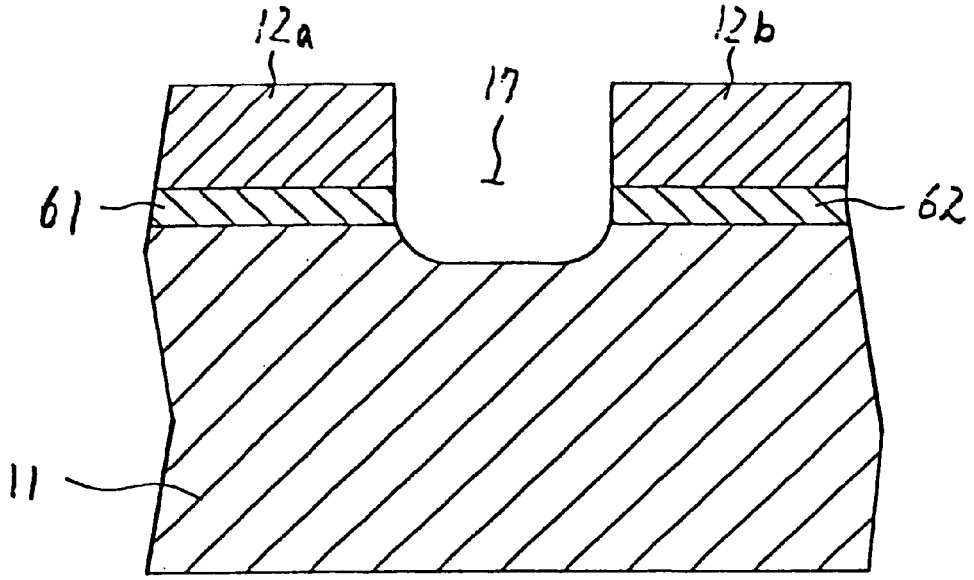
FIG. 12 is an enlarged view illustrating a part of the chip-type surge absorber shown in FIG. 11.

Referring to FIGS. 10 to 12, a sixth embodiment of a chip-type surge absorber according to the present invention and a production method thereof are described below. FIG. 10 is a perspective view generally illustrating the chip-type surge absorber according to the present embodiment, FIG. 11 is a longitudinal sectional view thereof, and FIG. 12 is an enlarged view illustrating a part thereof. Of the constituent elements of the chip-type surge absorber 60 according to the present embodiment, elements which are the same as or similar to those used in the first to fifth embodiment are denoted by similar reference numerals and they are not described in further detail herein.

As shown in FIGS. 10 and 11, the chip-type surge absorber 60 includes an insulating substrate 11 made of alumina or the like, discharge electrodes 12*a* and 12*b* formed on the insulating substrate 11, dielectric layers 61 and 62 disposed between the insulating substrate 11 and the respective discharge electrodes 12*a* and 12*b*, and a discharge gap 17 with a predetermined gap distance formed between the discharge electrodes 12*a* and 12*b*.

As shown in FIG. 10, the insulating substrate 11, on which the discharge electrodes 12*a* and 12*b* and the discharge gap 17 are formed, is covered with a hermetic cap 13 made of glass (insulating material). The hermetic cap 13 is adhesively bonded to a peripheral part of the insulating substrate 11 using an insulating glass adhesive (electrically insulating adhesive) such that a hermetically sealed cavity 18 is formed between the insulating substrate 11 and the hermetic cap 13. The hermetically sealed cavity 18 is filled with a preferable discharge gas such that the discharge electrodes 12*a* and 12*b* and the discharge gap 17 in the hermetically sealed space 18 are exposed to an ambient of the discharge gas.

In the chip-type surge absorber 60, as shown in FIG. 11, the outer-side end parts 33 and 34 of the respective discharge electrodes 12*a* and 12*b* extend to the end faces of the insulating substrate 11 and the hermetic cap 13 such that the discharge electrodes 12*a* and 12*b* are connected to respective terminal electrodes 14*a* and 14*b* disposed on the respective end faces of the insulating substrate 11 and the hermetic cap 13. That is, the connection part of the hermetic cap 13 to the insulating substrate 11 is located on the outer-side end parts 33 and 34 of the respective discharge electrodes 12*a* and 12*b* and on the peripheral part of the insulating substrate 11.

The dielectric layers 61 and 62 are disposed between the insulating substrate and the respective discharge electrodes 12*a* and 12*b*. The dielectric layers 61 and 62 are formed on the upper surface of the insulating substrate 11, in the areas corresponding to the discharge electrodes 12*a* and 12*b*. The dielectric layers 61 and 62 are formed of a material having a relative dielectric constant two or more times greater than that of the insulating substrate. The dielectric layers 61 and 62 are partially exposed in the discharge gap 17. In this specific embodiment, the insulating substrate 11 is formed of alumina (with a relative dielectric constant $\in_r=10$), and the dielectric layers 61 and 62 are formed of a material having a relative dielectric constant of 35000.

In order to produce the chip-type surge absorber having the above structure, dielectric layers 61 and 62 are first formed on the insulating substrate 11 by means of printing. The discharge electrodes 12*a* and 12*b* are then formed on the dielectric layers 61 and 62. The discharge gap 17 is then formed by illuminating the discharge electrodes 12*b* and 12*b* with a laser beam. In this process, a gap similar to the discharge gap 17 is also formed in the dielectric layers 61 and 62, and thus the dielectric layers 61 and 62 do not act as a capacitor.

Figure 16:
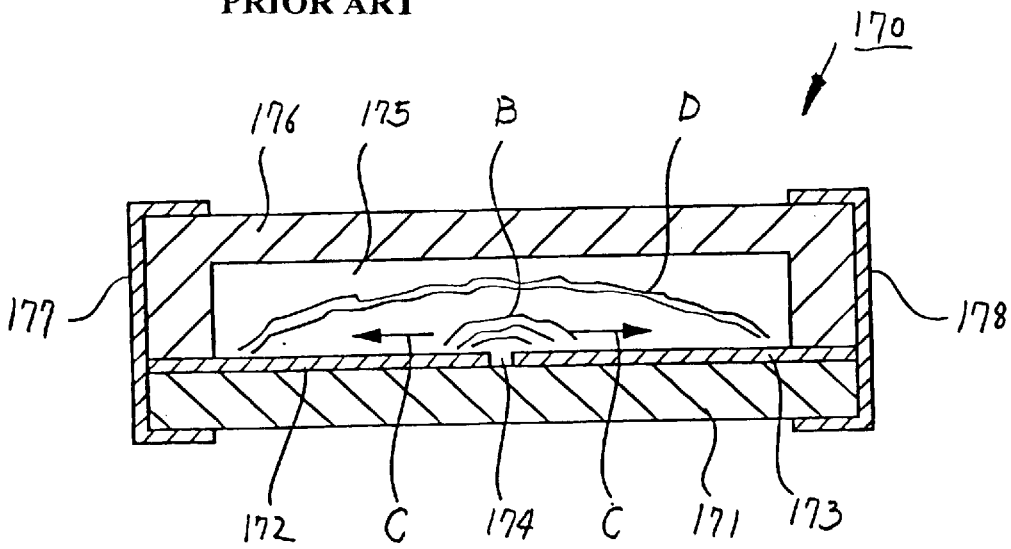
FIG.16 PRIOR ART
FIG. 16 is a longitudinal sectional view illustrating another example of a conventional chip-type surge absorber.
Figure 17:
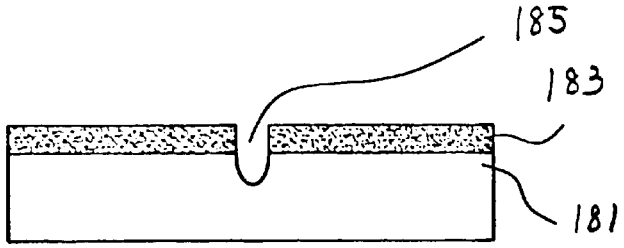
FIG.17 PRIOR ART
FIG. 17 is a side view illustrating main parts of another example of a conventional chip-type surge absorber.
Figure 18:
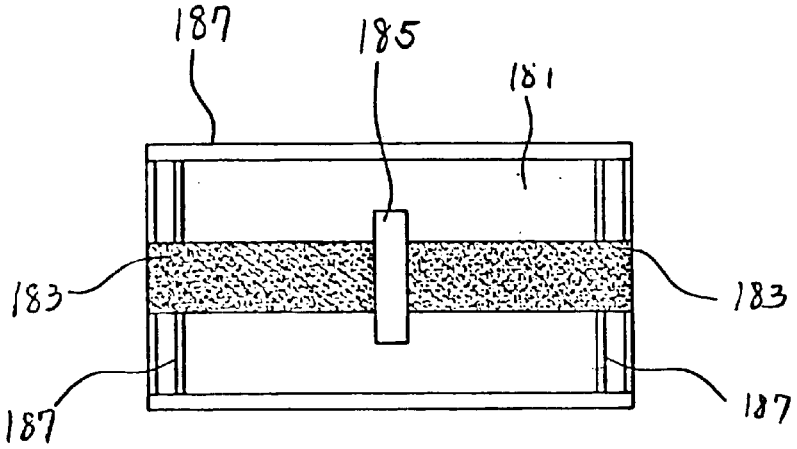
FIG.18 PRIOR ART
FIG. 18 is a plan view of the chip-type surge absorber shown in FIG. 17.
Figure 19:
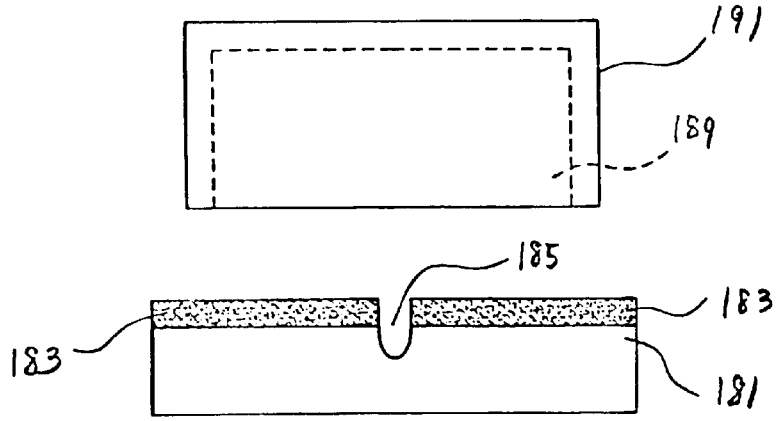
FIG.19 PRIOR ART
FIG. 19 is side view illustrating a process of adhesively bonding a cap in production of a chip-type surge absorber according to a conventional technique.

When a surge voltage is applied to the chip-type surge absorber 60 constructed in the above-described manner, a glow discharge is started between the inner-side end parts of the discharge electrodes 12*a* and 12*b* via the discharge gap 17. The glow discharge grows into a creeping discharge toward the outer-side end parts 33 and 34 of the discharge electrodes 12*a* and 12*b*, and, finally, an arc discharge occurs between the outer-side end parts 33 and 34, thereby absorbing the surge voltage (refer to FIG. 16).

Because the dielectric layers 61 and 62 having a relative dielectric constant greater than that of the insulating substrate 11 exist between the insulating substrate 11 and the respective discharge electrodes 12*a* and 12*b*, an electric field is concentrated in the dielectric layers 61 and 62 via the discharge electrodes 12*a* and 12*b* when a surge is applied. As a result, electrons are emitted by mean of field emission from the discharge electrodes 12*a* and 12*b* in contact with the dielectric layers 61 and 62. This makes it possible to start the emission of electrons between the discharge electrodes 12*a* and 12*b* at a low voltage, without having limitations in terms of the work function of the discharge electrodes 12*a* and 12*b* and in terms of the kind of gas. Thus, a chip-type surge absorber which can operate at a low voltage in a highly reliable fashion can be obtained.

The above advantages can be achieved only by forming the dielectric layers 61 and 62 on the insulating substrate 11, in the areas corresponding to the respective discharge electrodes 12*a* and 12*b*. Furthermore, because the gap is also formed between the dielectric layers 61 and 62, no increase occurs in the total capacitance, and therefore the chip-type surge absorber according to the present embodiment can also be used in high-frequency circuits. The dielectric layers 61 and 62 can be formed easily between the insulating substrate 11 and the discharge electrodes 12*a* and 12*b*, unlike the chip-type surge absorber disclosed in Japanese Unexamined Patent Application Publication No. 2000-12186, which needs difficult processing such as CVD or slurry processing to form diamond.

Samples of chip-type surge absorbers were actually produced according to the present embodiment. Alumina was used as the material of the insulating substrate 11, and the dielectric layers 61 and 62 were formed on the insulating substrate 11 to a thickness of 5 $\mu$m. The discharge electrodes 12*a* and 12*b* with a thickness of 10 $\mu$m was then formed using BaAl. The discharge gap 17 having a gap distance of 20 $\mu$m and a depth of 20 $\mu$m was formed. The resultant chip-type surge absorbers had a capacitance smaller than 1 pF and a DC discharge start voltage of 100 V.

For the purpose of comparison, samples of chip-type surge absorbers of Comparative Example 6 were also produced in a similar manner except that no dielectric layers 61 and 62 were formed. Although the samples had low capacitance of 1 pF, the DC discharge start voltage was as high as 200 V. Samples of chip-type surge absorbers of Comparative Example 7 were also produced in such a manner that the alumina substrate was replaced with a substrate made of a dielectric material having a relative dielectric constant of 3500. The obtained samples had capacitance of 5 pF and a DC discharge start voltage of 140 V. The result indicates that the existence of the dielectric layers assures a reduction in the operating voltage.

In the present embodiment, because alumina was employed as the material of the insulating substrate 11, the dielectric layers 61 and 62 were formed using a dielectric material having a relative dielectric constant ($\in_r$) of 3500. However, the relative dielectric constant is not limited to that, and may be selected within the range of 10 to 100000 and more preferable within the range of 1000 to 30000, depending upon the material of the insulating substrate 1. The thickness of the dielectric layers 61 and 62 is preferably in the range from 1 to 1000 $\mu$m. However, in order to obtain low capacitance, it is more preferable to select the thickness of the dielectric layers 61 and 62 within the range from 10 to 20 $\mu$m.

Numerous additional modifications and variations of the present invention are possible in light of the above teachings. It is therefore to be understood that within the scope of the appended claims, the present invention may be practiced otherwise than as specifically described herein.

What is claimed as new and desired to be secured by Letter Patent of the United States is:

1. A chip-type surge absorber, comprising:

an insulating substrate in the shape of a rectangular parallelepiped;

an insulating hermetic cap open at a bottom side thereof, for forming, together with said insulating substrate, a box-shaped hermetically sealed cavity filled with a discharge gas;

terminal electrodes disposed on both ends of said hermetically sealed cavity and extending to and over on side walls of said hermetically sealed cavity;

a pair of discharge electrodes disposed within said hermetically sealed cavity, having a discharge gap formed between said discharge electrodes, and electrically connected to the corresponding terminal electrodes; and connection surfaces formed in a slope and configured to increase a connection area for a connection between the discharge electrodes and the terminal electrodes.

2. A chip-type surge absorber, comprising:

an insulating substrate in the shape of a rectangular parallelepiped;

an insulating hermetic cap open at a bottom side thereof, for forming, together with said insulating substrate, a box-shaped hermetically sealed cavity filled with a discharge gas;

terminal electrodes disposed on both ends of said hermetically sealed cavity and extending to and over on side walls of said hermetically sealed cavity;

two to five pairs of discharge electrodes disposed within said hermetically sealed cavity, having a discharge gas formed between each pair of discharge electrodes, and electrically connected to the corresponding terminal electrodes; and connection surfaces formed in a slope and configured to increase a connection area for a connection between the discharge electrodes and the terminal electrodes.

3. The chip-type surge absorber as in claim 1 or 2, wherein said discharge electrodes are formed at opposing positions on said insulating substrate such that a discharge gap is formed between said discharge electrodes, and further comprising:

a hermetic cap having a peripheral part thereof adhesively bonded to said insulating substrate such that a space above said discharge electrodes is enclosed by said hermetic cap, wherein each of said discharge electrodes has an outer-side end part at a location where said hermetic cap and said insulating substrate are adhesively bonded to each other, and said outer-side end part has a lower electrical resistance than the electrical resistance of the inner-side part of a discharge electrode directly adjacent to said discharge gap.

4. A chip-type surge absorber, comprising:

an insulating substrate in the shape of a rectangular parallelepiped having a cavity extending through said insulating substrate;

a pair of terminal electrodes which are disposed on the respective ends of said insulating substrate such that said cavity is closed by said terminal electrodes;

a hermetically sealed cavity which is enclosed by said insulating substrate and said terminal electrodes and which is filled with a discharge gas; and a pair of discharge electrodes which are formed within said hermetically sealed cavity and on one inner surface of said insulating substrate such that a discharge gap is formed between said discharge electrodes, said discharge electrodes being electrically connected with corresponding said terminal electrodes, wherein a relay electrode for relaying an arc discharge is formed within said hermetically sealed cavity and on the other inner surface of said insulating substrate such that said relay electrode is isolated from said discharge electrodes and said terminal electrodes.

5. The chip-type surge absorber of claim 4, wherein the inner end parts, between the ends of the relay electrode and the terminal electrodes, of said insulating substrate are partially cut out inward.

6. The chip-type surge absorber of claim 5, wherein there are a plurality of said discharge gaps.

7. The chip-type surge absorber of claim 4, wherein there are a plurality of said discharge gaps.

8. A chip-type surge absorber, comprising:

a heat-resistant insulating substrate;

a pair of discharge electrodes which are formed on said heat-resistant insulating substrate such that a small gap is formed between said discharge electrodes; and a hermetic cap which is adhesively connected to said insulating substrate such that said small gap is enclosed in a hermetically sealed space formed by said hermetic cap, wherein a stripe-shaped insulating layer having heat resistance lower at least than the heat resistance of said insulating substrate is formed between said insulating substrate and said discharge electrodes.

9. The chip-type surge absorber of claim 8, wherein said heat-resistant insulating layer is formed on an a flat substrate surface of said insulating substrate, and said discharge electrodes are formed on said heat-resistant insulating layer.

10. A method of producing a chip-type surge absorber, comprising the steps of:

forming a stripe-shaped insulating layer on a flat substrate surface of a heat-resistant insulating substrate, said insulating layer having lower heat resistance than the heat resistance of said insulating substrate;

forming an electrically conductive film having the same stripe shape as said stripe-shaped insulating layer on said stripe-shaped insulating layer having low heat resistance into a multilayer structure; and cutting said electrically conductive film together with said insulating layer having low heat resistance in a direction perpendicular to the longitudinal direction by means of laser cutting, into two portions which serve as a pair of discharge electrodes spaced from each other by a small gap.

11. A chip-type surge absorber, comprising:

an insulating substrate;

discharge electrodes which are formed at opposing positions on said insulating substrate such that a discharge gap is formed between the discharge electrodes; and dielectric layers disposed between said insulating substrate and respective said discharge electrodes, wherein said dielectric layers have a relative dielectric constant greater than that of the relative dielectric constant of said insulating substrate, and at least a part of each of said dielectric layers is exposed in said discharge gap.

12. The chip-type surge absorber of claim 11, wherein said dielectric layers are made of a material having a relative dielectric constant at least 2 times greater than that of said insulating substrate.

* * * * *

UNITED STATES PATENT AND TRADEMARK OFFICE

CERTIFICATE OF CORRECTION

PATENT NO. : 6,606,230 B2
DATED : August 12, 2003
INVENTOR(S) : Sawada et al.

It is certified that error appears in the above-identified patent and that said Letters Patent is hereby corrected as shown below:

Title page,
Item [75], should read:
-- [75] Inventors: Yoshihisa Sawada, Tokyo (JP); Yoshiyuki Tanaka, Tokyo (JP); Kouichirou Harada, Tokyo (JP); Yasuhiro Shato, Tokyo (JP); Naoto Kitahara, Tokyo (JP); Kazutaka Hujiwara, Tokyo (JP); Takahiro Nakamoto, Tokyo (JP); Heisen Ryu, Tokyo (JP); Hitoshi Inaba, Tokyo (JP); Nobuya Saruwatari, Tokyo (JP) --

Signed and Sealed this

Ninth Day of December, 2003

JAMES E. ROGAN
*Director of the United States Patent and Trademark Office*